US009346582B2

(12) United States Patent
Pinkstone

(10) Patent No.: US 9,346,582 B2
(45) Date of Patent: May 24, 2016

(54) CARTONS WITH RECLOSABLE FEATURES

(71) Applicant: Graphic Packaging International, Inc., Atlanta, GA (US)

(72) Inventor: Felicia A. Pinkstone, Aston, PA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/449,501

(22) Filed: Aug. 1, 2014

(65) Prior Publication Data

US 2015/0034711 A1 Feb. 5, 2015

Related U.S. Application Data

(60) Provisional application No. 61/958,659, filed on Aug. 2, 2013.

(51) Int. Cl.

| | |
|---|---|
| ***B65D 5/54*** | (2006.01) |
| ***B65D 5/66*** | (2006.01) |
| ***B31B 1/26*** | (2006.01) |

(52) U.S. Cl.

CPC ..... *B65D 5/5415* (2013.01); *B31B 1/26* (2013.01); *B65D 5/6608* (2013.01)

(58) Field of Classification Search

CPC .. B65D 5/5415; B65D 5/6608; B65D 5/2057; B65D 5/5425; B65D 5/665; B65D 5/6664; B31B 1/26

USPC ..... 229/226, 232, 225, 224

See application file for complete search history.

(56) References Cited

U.S. PATENT DOCUMENTS

| | | | |
|---|---|---|---|
| 1,772,625 | A | 8/1930 | Caulfield |
| 2,139,021 | A | 12/1938 | Johnson |
| 2,192,722 | A | 3/1940 | Vogt |
| 2,251,283 | A | 8/1941 | Johnson |
| 2,292,573 | A | 8/1942 | Kondolf |
| 2,335,913 | A | 12/1943 | Buttery |

(Continued)

FOREIGN PATENT DOCUMENTS

| | | |
|---|---|---|
| DE | 29 23 455 | 12/1980 |
| DE | 81 10 323.9 | 9/1981 |

(Continued)

OTHER PUBLICATIONS

International Search Report and Written Opinion for PCT/US2014/049367 dated Nov. 14, 2014.

*Primary Examiner* — Christopher Demeree

(74) *Attorney, Agent, or Firm* — Womble Carlyle Sandridge & Rice, LLP

(57) ABSTRACT

A carton for holding a product is disclosed. The carton comprises a plurality of panels that extends at least partially around an interior of the carton. The plurality of panels comprise a front panel, a back panel, a first side panel, and a second side panel. The carton further comprises a hinge in at least one of the plurality of panels and a reclosable lid pivotably attached to the carton. The reclosable lid comprises a first intermediate panel foldably connected to at least one of the plurality of panels and a second intermediate panel foldably connected to the first intermediate panel. The first intermediate panel is positioned in face-to-face contact with the second intermediate panel. The reclosable lid is pivotable at the hinge between a closed position preventing access to the interior of the carton and an open position allowing access to the interior of the carton.

63 Claims, 22 Drawing Sheets

(56) References Cited

U.S. PATENT DOCUMENTS

| | | | | | |
|---|---|---|---|---|---|
| 2,337,892 | A | | 12/1943 | Hultin | |
| 2,345,486 | A | | 3/1944 | Nathan | |
| 2,355,665 | A | | 8/1944 | Mabee | |
| 2,369,387 | A | * | 2/1945 | Williamson | B65D 5/6608 206/268 |
| 2,369,392 | A | * | 2/1945 | Ringler | B65D 5/6608 206/268 |
| 2,396,310 | A | | 3/1946 | Gibson | |
| 2,437,926 | A | | 3/1948 | Ball et al. | |
| 2,594,394 | A | | 4/1952 | Casselman et al. | |
| 2,973,086 | A | | 2/1961 | Thompson | |
| 3,013,712 | A | | 12/1961 | Wollaeger | |
| 3,021,002 | A | | 2/1962 | Guyer | |
| 3,033,362 | A | | 5/1962 | Marcalus | |
| 3,180,556 | A | | 4/1965 | Asman | |
| 3,295,742 | A | * | 1/1967 | Coe | B65D 5/6608 229/132 |
| 3,355,089 | A | | 11/1967 | Champlin | |
| 3,363,822 | A | | 1/1968 | Maulini et al. | |
| 3,426,955 | A | | 2/1969 | Olson | |
| 3,486,682 | A | | 12/1969 | Whipperman | |
| 3,578,234 | A | | 5/1971 | Marchisen | |
| 3,669,345 | A | | 6/1972 | Cole | |
| 3,680,766 | A | | 8/1972 | Collura et al. | |
| 3,690,544 | A | | 9/1972 | Meyers | |
| 3,768,719 | A | | 10/1973 | Johnson | |
| 4,262,816 | A | | 4/1981 | Margulies | |
| 4,344,537 | A | | 8/1982 | Austin | |
| 4,484,683 | A | | 11/1984 | Werner, Jr. | |
| 4,508,218 | A | | 4/1985 | Focke et al. | |
| 4,512,476 | A | | 4/1985 | Herrington, Jr. | |
| 4,558,785 | A | | 12/1985 | Gordon | |
| 4,572,423 | A | | 2/1986 | Spencer | |
| 4,584,202 | A | | 4/1986 | Roccaforte | |
| 4,621,736 | A | | 11/1986 | Roccaforte | |
| 4,645,108 | A | | 2/1987 | Gavin et al. | |
| 4,676,394 | A | | 6/1987 | Hiersteiner | |
| 4,746,019 | A | | 5/1988 | Prater | |
| 4,768,703 | A | | 9/1988 | Sosler et al. | |
| 4,863,052 | A | | 9/1989 | Lambert | |
| 4,905,898 | A | | 3/1990 | Wade | |
| 4,948,038 | A | | 8/1990 | Moeller | |
| 5,265,799 | A | | 11/1993 | Stone | |
| 5,347,865 | A | | 9/1994 | Mulry et al. | |
| 5,356,022 | A | | 10/1994 | Tipps | |
| 5,363,981 | A | | 11/1994 | Giblin et al. | |
| 5,427,267 | A | | 6/1995 | Willman | |
| 5,632,402 | A | | 5/1997 | Walsh et al. | |
| 5,632,404 | A | | 5/1997 | Walsh | |
| 5,746,871 | A | | 5/1998 | Walsh | |
| 5,783,030 | A | | 7/1998 | Walsh | |
| 5,794,811 | A | | 8/1998 | Walsh | |
| 5,794,812 | A | | 8/1998 | Walsh | |
| 5,857,614 | A | | 1/1999 | Walsh | |
| 5,918,799 | A | | 7/1999 | Walsh | |
| 5,960,555 | A | | 10/1999 | Deaton et al. | |
| 5,996,797 | A | | 12/1999 | Flaig | |
| 6,102,277 | A | | 8/2000 | Krapohl, Sr. | |
| 6,352,096 | B1 | | 3/2002 | Walsh | |
| 6,364,202 | B1 | | 4/2002 | Zelley | |
| 6,520,404 | B1 | | 2/2003 | Waldburger et al. | |
| 6,568,586 | B1 | | 5/2003 | VanEsley et al. | |
| 6,761,269 | B2 | | 7/2004 | Hamming | |
| 6,854,639 | B2 | | 2/2005 | Walsh | |
| 6,869,009 | B2 | | 3/2005 | Sutherland et al. | |
| 7,025,504 | B2 | | 4/2006 | Olin | |
| 7,407,087 | B2 | | 8/2008 | DeBusk et al. | |
| 7,699,214 | B2 | | 4/2010 | Mestre et al. | |
| 7,703,665 | B2 | | 4/2010 | McGowan | |
| 8,002,171 | B2 | | 8/2011 | Ryan et al. | |
| 2001/0048022 | A1 | | 12/2001 | Zoeckler | |
| 2002/0036153 | A1 | | 3/2002 | Yang | |
| 2002/0055429 | A1 | | 5/2002 | Walsh | |
| 2003/0144121 | A1 | | 7/2003 | Walsh et al. | |
| 2004/0007614 | A1 | | 1/2004 | Saulas | |
| 2004/0226989 | A1 | | 11/2004 | Cook et al. | |
| 2005/0109827 | A1 | | 5/2005 | Martin | |
| 2005/0187087 | A1 | | 8/2005 | Walsh | |
| 2006/0049067 | A1 | | 3/2006 | McDonald | |
| 2006/0243783 | A1 | | 11/2006 | Spivey, Sr. et al. | |
| 2006/0255105 | A1 | | 11/2006 | Sweet | |
| 2006/0255107 | A1 | | 11/2006 | Wright | |
| 2006/0266810 | A1 | | 11/2006 | Foushee | |
| 2009/0001145 | A1 | | 1/2009 | Hasse et al. | |
| 2013/0193197 | A1 | | 8/2013 | Low et al. | |

FOREIGN PATENT DOCUMENTS

| | | | |
|---|---|---|---|
| DE | 87 08 078.8 | | 10/1987 |
| DE | 94 13 813 | | 10/1994 |
| EP | 0 406 556 | | 1/1991 |
| EP | 1 457 425 | | 9/2004 |
| FR | 2 699 150 | | 6/1994 |
| FR | 2 755 670 | | 5/1998 |
| GB | 104 445 | | 3/1917 |
| GB | 1 242 356 | | 8/1971 |
| GB | 1 489 963 | | 10/1977 |
| GB | 1 584 066 | | 2/1981 |
| GB | 2 137 172 | A | 10/1984 |
| GB | 2 363 372 | | 12/2001 |
| JP | 2010-184713 | A | 8/2010 |
| JP | 2011-084279 | A | 4/2011 |
| WO | WO 95/28325 | | 10/1995 |
| WO | WO 2006/133401 | | 12/2006 |

* cited by examiner

CARTONS WITH RECLOSABLE FEATURES

CROSS-REFERENCE TO RELATED APPLICATIONS

This application claims the benefit of U.S. Provisional Application No. 61/958,659, which was filed on Aug. 2, 2013.

INCORPORATION BY REFERENCE

U.S. Provisional Application No. 61/958,659, which was filed on Aug. 2, 2013, is hereby incorporated by reference for all purposes as if presented herein in its entirety.

BACKGROUND OF THE DISCLOSURE

The present disclosure generally relates to packages or cartons for holding and dispensing products, such as food products. More specifically, the present disclosure relates to cartons with reclosable features.

SUMMARY OF THE DISCLOSURE

In general, one aspect of the disclosure is generally directed to a carton for holding and dispensing a product. The carton comprises a plurality of panels that extends at least partially around an interior of the carton. The plurality of panels comprise a front panel, a back panel, a first side panel, and a second side panel. The carton further comprises a hinge in at least one of the plurality of panels and a reclosable lid pivotably attached to the carton. The reclosable lid comprises a first intermediate panel foldably connected to at least one of the plurality of panels and a second intermediate panel foldably connected to the first intermediate panel. The first intermediate panel is positioned in face-to-face contact with the second intermediate panel. The reclosable lid is pivotable at the hinge between a closed position preventing access to the interior of the carton and an open position allowing access to the interior of the carton.

In another aspect, the disclosure is generally directed to a blank for forming a carton for holding and dispensing a product. The blank comprises a plurality of panels. The plurality of panels comprise a front panel, a back panel, a first side panel, and a second side panel. The blank further comprises a hinge in at least one of the plurality of panels and lid features for forming a reclosable lid. The reclosable lid comprises a first intermediate panel foldably connected to at least one of the plurality of panels and a second intermediate panel foldably connected to the first intermediate panel. The first intermediate panel is for being positioned in face-to-face contact with the second intermediate panel when the blank is formed into a carton.

In another aspect, the disclosure is generally directed to a method of forming a carton for holding and dispensing a product. The method comprises obtaining a blank comprising a plurality of panels. The plurality of panels include a front panel, a back panel, a first side panel, and a second side panel. The blank further includes a hinge in at least one of the plurality of panels and lid features for forming a reclosable lid. The lid features include a first intermediate panel foldably connected to at least one of the plurality of panels along at least one tear line, and a second intermediate panel foldably connected to the first intermediate panel. The method further comprises forming an interior of the carton at least partially defined by the plurality of panels and forming the reclosable lid by positioning the first intermediate panel in face-to-face contact with the second intermediate panel, the reclosable lid is pivotable at the hinge between a closed position preventing access to the interior of the carton and an open position allowing access to the interior of the carton.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Cartons or packages according to the present disclosure can accommodate articles of numerous different shapes. For the purpose of illustration and not for the purpose of limiting the scope of the disclosure, the following detailed description describes articles at least partially disposed within the carton embodiments. In one embodiment, the articles held in the carton can be food products, but the articles could be other nonfood products without departing from the disclosure. In this specification, the terms "lower," "bottom," "upper", "top", "front", and "back" indicate orientations determined in relation to fully erected cartons.

Figure 1:
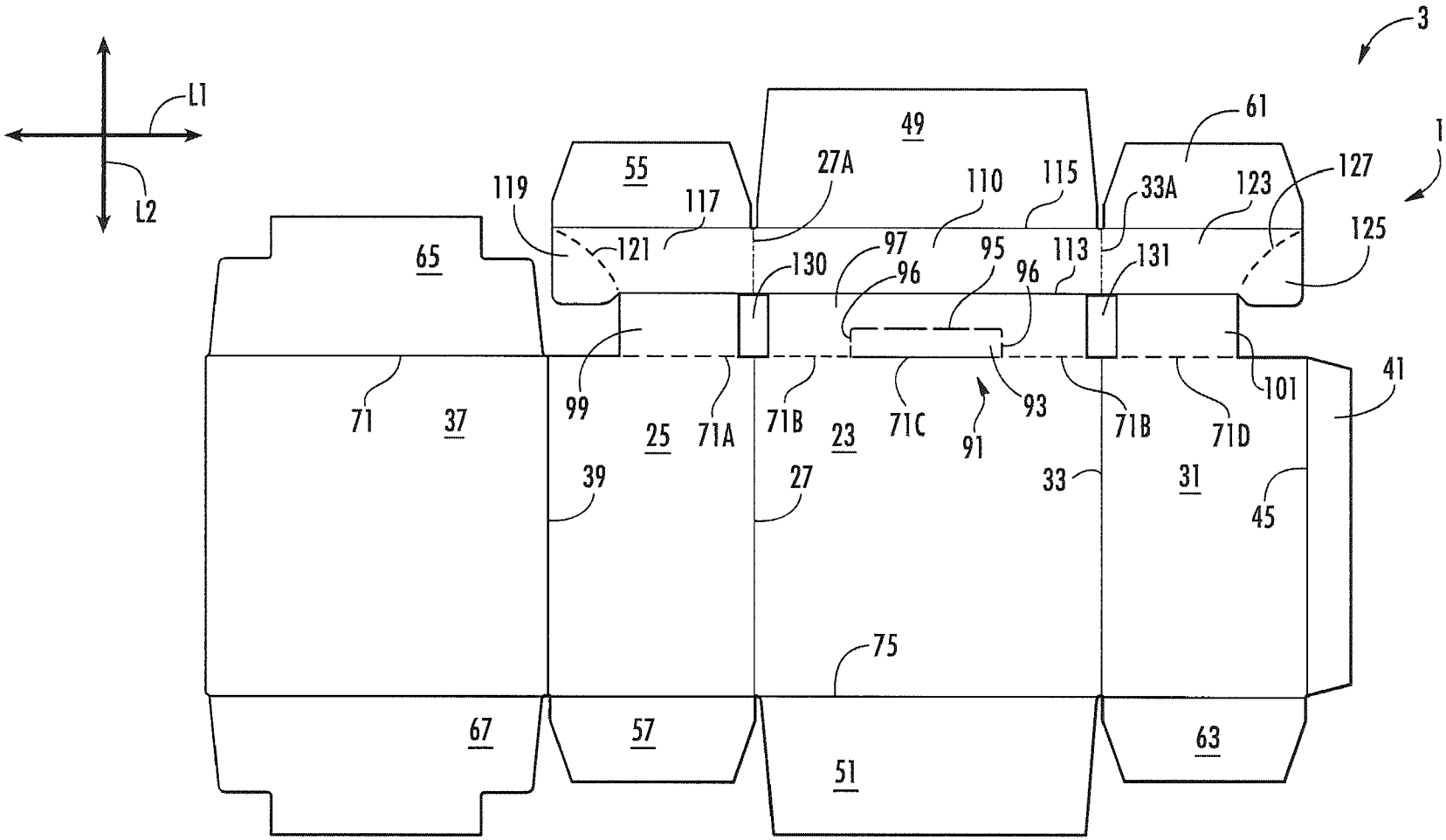
FIG. 1 is an exterior plan view of a blank used to form a carton in accordance with a first embodiment of the disclosure.
Figure 11:
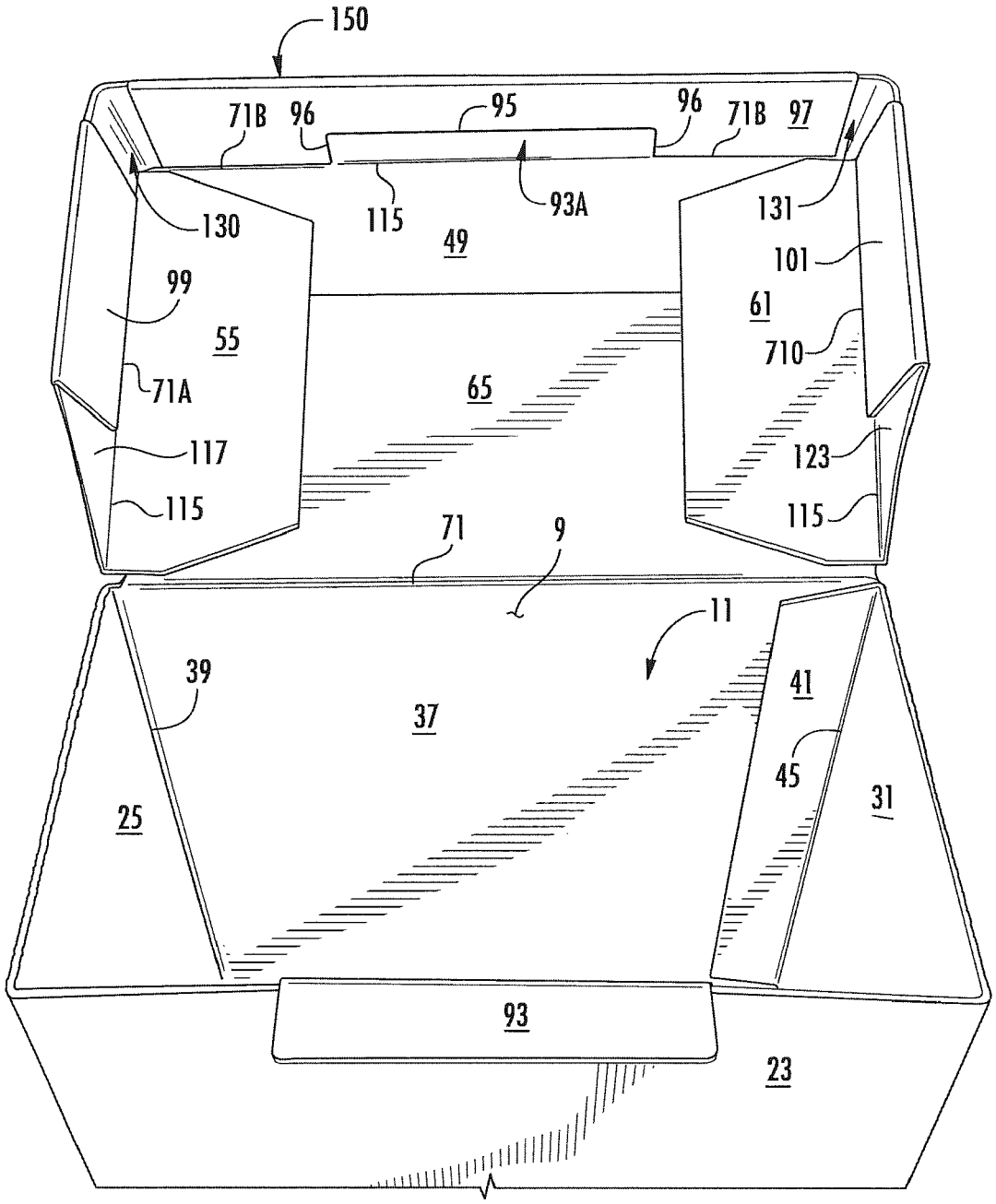
FIG. 11 is a top perspective view of the carton in the open configuration.

FIG. 1 is a plan view of an exterior surface 1 of a blank 3 used to form a carton 5 (FIG. 8) of a first embodiment of the disclosure. In one embodiment, the carton 5 may include a liner, bag, or other construct (not shown) that is in contact with an interior surface 9 of the carton 5 (FIG. 11). The carton 5 can be configured to hold articles (not shown) such as a plurality of food products (e.g., candy, crackers, popcorn, breakfast cereal, or any other food product) or nonfood products (cotton swabs, bandages, detergent, or any other nonfood product), or any other suitable article or product within an interior 11 (FIG. 11) of the carton 5. The carton 5 includes a reclosable lid 8 that is pivotable between a closed position (FIG. 8) and an open position (FIG. 11). The carton 5 can include various dispensing features and various opening/closing features without departing from the disclosure.

The blank 3 has a longitudinal axis L1 extending generally in the direction of the length of the blank and a lateral axis L2 extending generally in the direction of the width of the blank. The blank 3 includes a front panel 23 foldably connected to a first side panel 25 at a lateral fold line 27. A second side panel 31 is foldably connected to the front panel 23 at a lateral fold line 33. A back panel 37 is foldably connected to first side panel 25 at a lateral fold line 39. An attachment flap 41 is foldably connected to the second side panel 31 at a lateral fold line 45. Alternatively, the attachment flap 41 could be foldably connected to the back panel 37.

Figure 8:
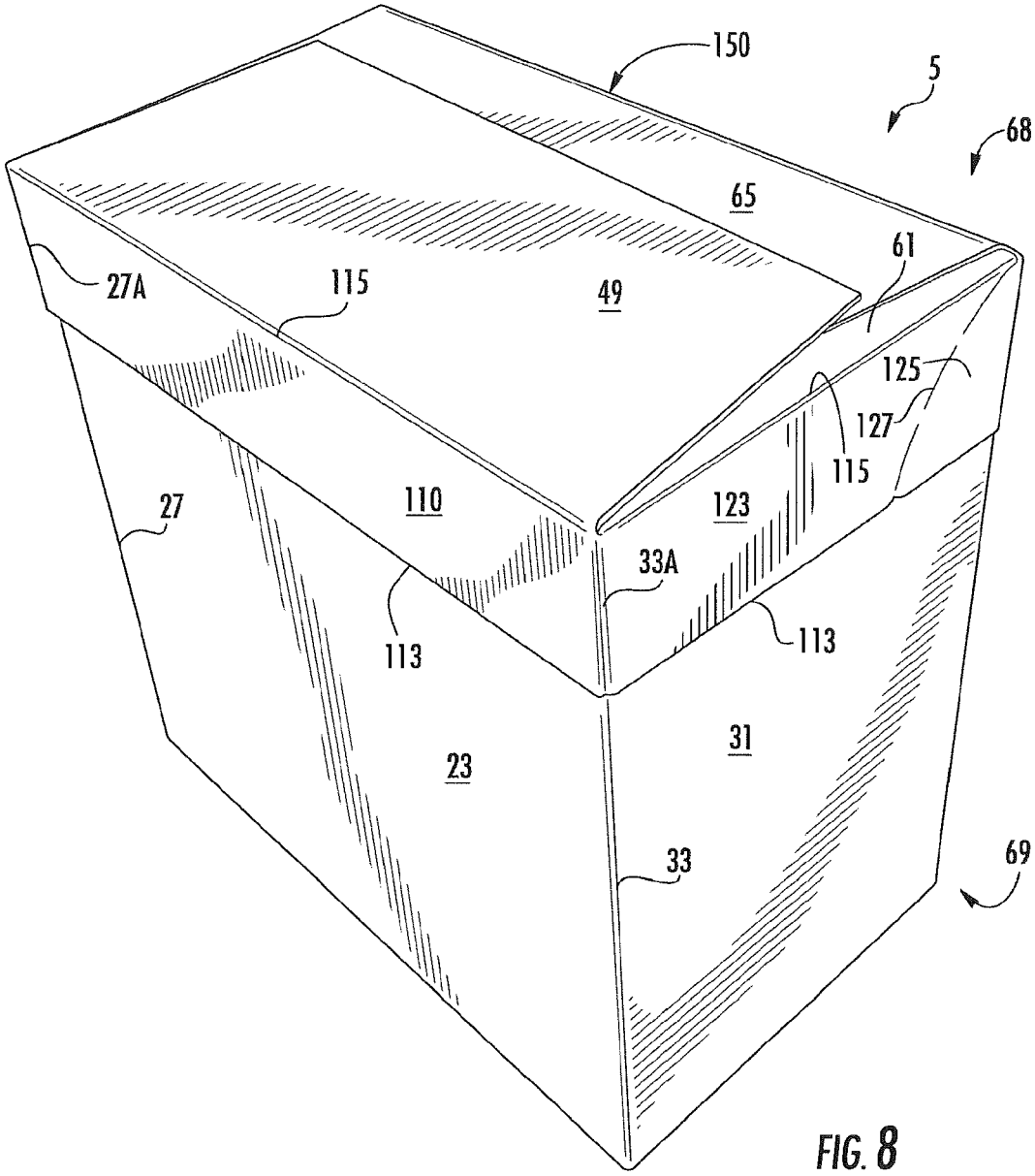
FIG. 8 is a front perspective view of the carton fully assembled.
Figure 9:
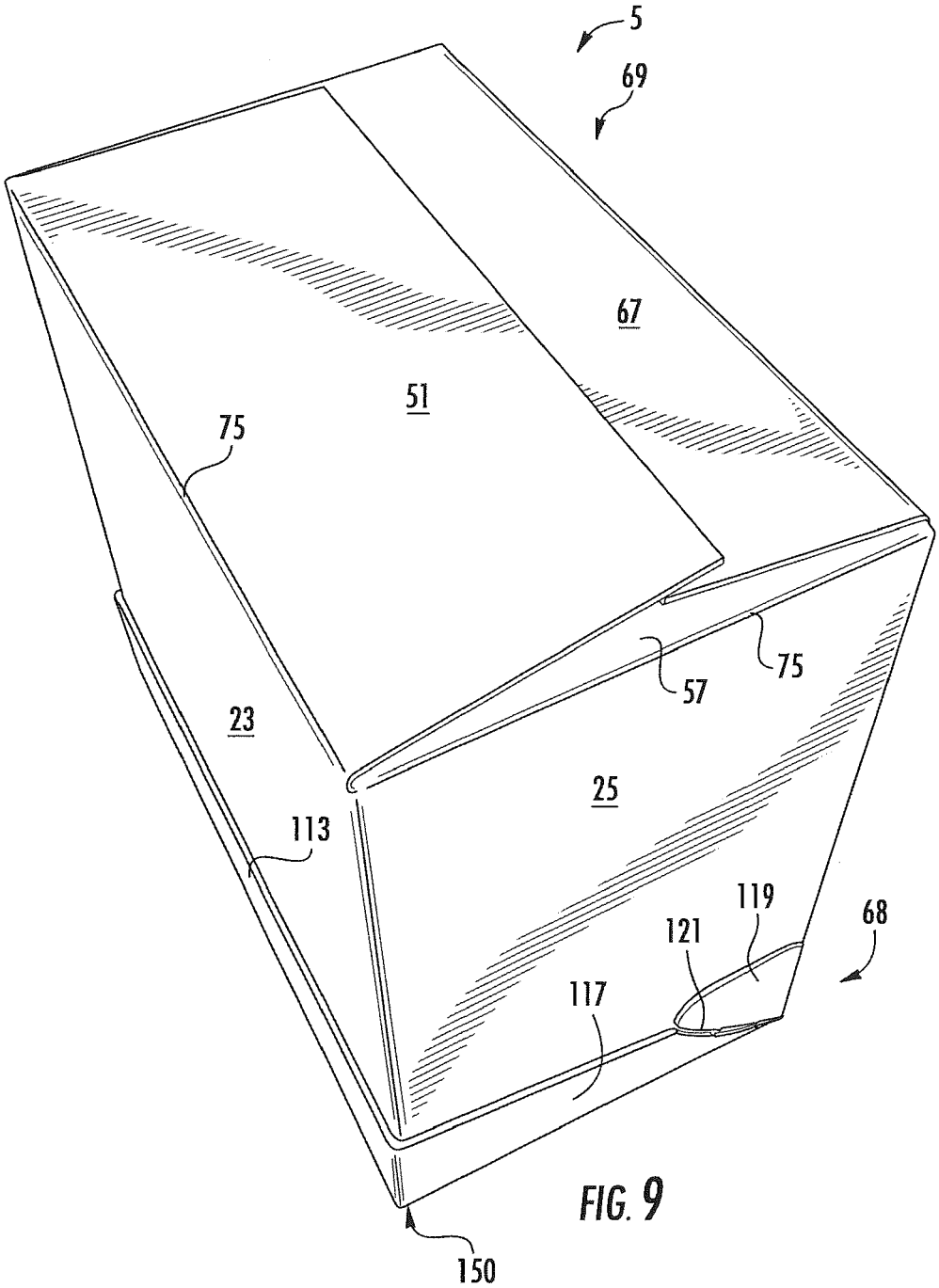
FIG. 9 is a bottom perspective view of the carton in the closed configuration.

In the illustrated embodiment, two end flaps 49, 51 are foldably connected to opposite ends of the front panel 23. Two end flaps 55, 57 are foldably connected to opposite ends of the first side panel 25. Two end flaps 61, 63 are foldably connected to opposite ends of the second side panel 31. Two end flaps 65, 67 are foldably connected to opposite ends of the back panel 37. When the carton 5 is erected, the end flaps 49, 55, 61, 65 close a first (e.g., top) end 68 of the carton, and the end flaps 51, 57, 63, 67 close a second (e.g., bottom) end 69 of the carton (FIG. 8). In accordance with an alternative embodiment of the present disclosure, different panel and flap arrangements can be used for closing the carton 5.

The end flap 65 is foldably connected to the back panel 37 at a first longitudinal fold line 71. The end flaps 51, 57, 63, 67 of the second end 69 are foldably connected at a second longitudinal fold line 75 that extends along the length of the blank. The longitudinal fold lines 71, 75 may be, for example, substantially straight, or offset at one or more locations to account for blank thickness or for other factors. The end flaps 49, 55, 61, 65, 51, 57, 63, 67 can be alternatively shaped, arranged, positioned, and/or omitted without departing from the disclosure.

As shown in FIG. 1, lid features 91 connect the end flaps 49, 55, 61 to a respective one of the panels 23, 25, 31. The lid features are configured to facilitate formation of the reclosable lid 8 of the carton 5. In the illustrated embodiment, the lid features 91 include a first front intermediate panel (broadly "first intermediate panel") 97 that is foldably connected to the front panel 23 at tear lines 71B, 71C. The intermediate panel 97 includes a locking tab 93 foldably connected to the front panel 23 at the longitudinal fold line 71C. The locking tab 93 is defined in the first front intermediate panel 97 by tear lines 95, 96, which define a perimeter of the locking tab 93. The lid features 91 further include a second front intermediate panel (broadly "second intermediate panel") 110 foldably connected to the first front intermediate panel 97 at longitudinal fold line 113. The second front intermediate panel 110 is foldably connected to the end panel 49 at a longitudinal fold line 115. In the illustrated embodiment, the end flap 49 is foldably connected to the front panel 23 by the lid features 91 that include the first front intermediate panel 97 and the second front intermediate panel 110.

The lid features 91 further include a first side intermediate panel 99 (broadly "third intermediate panel") foldably connected to the first side panel 25 at tear line 71A. In one embodiment, the first side intermediate panel 99 is separated from the first front intermediate panel 97 by a rectangular cutout 130. A second side intermediate panel (broadly "fourth intermediate panel") 117 is foldably connected to the first side intermediate 99 at a longitudinal fold line 114. The second side intermediate panel 117 is foldably connected to the second front intermediate panel 110 at a lateral fold line 27A. The second side intermediate panel 117 is foldably connected to the end flap 55 at longitudinal fold line 120. The second side intermediate panel 117 includes a corner portion 119 defined by a tear line 121. In the illustrated embodiment, the end flap 55 is connected to the first side panel 25 by the lid features 91 that include the first side intermediate panel 99 and the second side intermediate panel 117.

In the embodiment of FIG. 1, the end flap 61 is connected to the second side panel 31 by similar lid features 91 that connect the end flap 55 and the first side panel 25. For example, the lid features 91 include a third side intermediate panel (broadly "fifth intermediate panel") 101 foldably connected to the second side panel 31 at a tear line 71D. As shown in FIG. 1, the third side intermediate panel 101 is separate from the first front intermediate panel 97 by a rectangular cutout 131. It is understood that the cutouts 130, 131 could be otherwise shaped arranged, configured, and/or omitted without departing from the disclosure. A fourth side intermediate panel (broadly "sixth intermediate panel") 123 is foldably connected to third side intermediate panel 101 at a longitudinal fold line 116. The fourth side intermediate panel 123 is foldably connected to the second front intermediate panel 110 at a lateral fold line 33A. The fourth side intermediate panel 123 is foldably connected to the end flap 61 at a longitudinal fold line 122. The fourth side intermediate panel 123 includes a corner portion 125 defined by a tear line 127. In the illustrated embodiment, the end flap 61 is foldably connected to the second side panel 31 by the lid features 91 that include the third intermediate side panel 101 and the fourth intermediate side panel 123. The lid features 91 can be otherwise shaped, arranged, and/or configured without departing from the scope of this disclosure.

Figure 2:
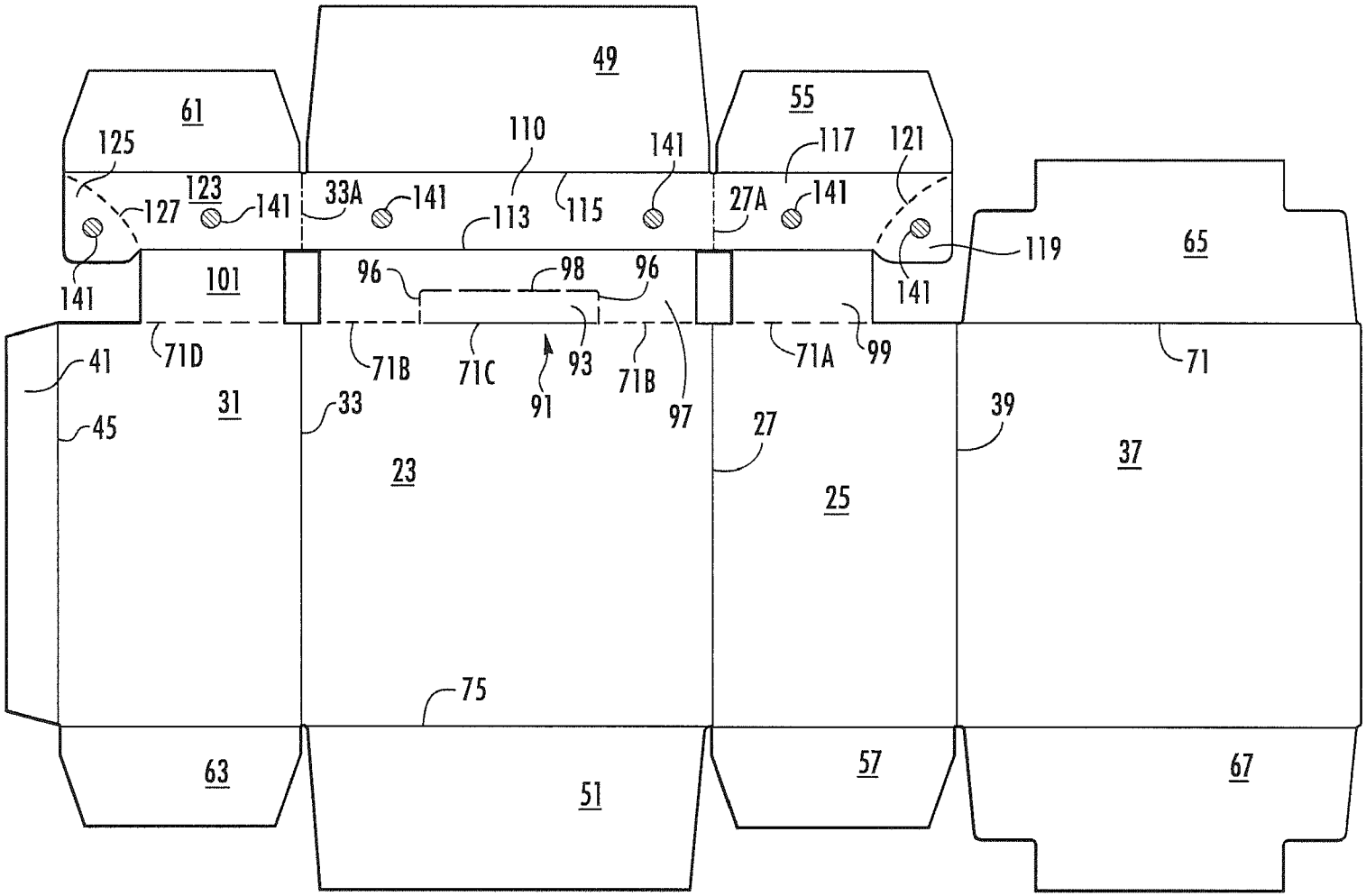
FIG. 2 is a plan view of the interior surface of the blank of FIG. 1.
Figure 3:
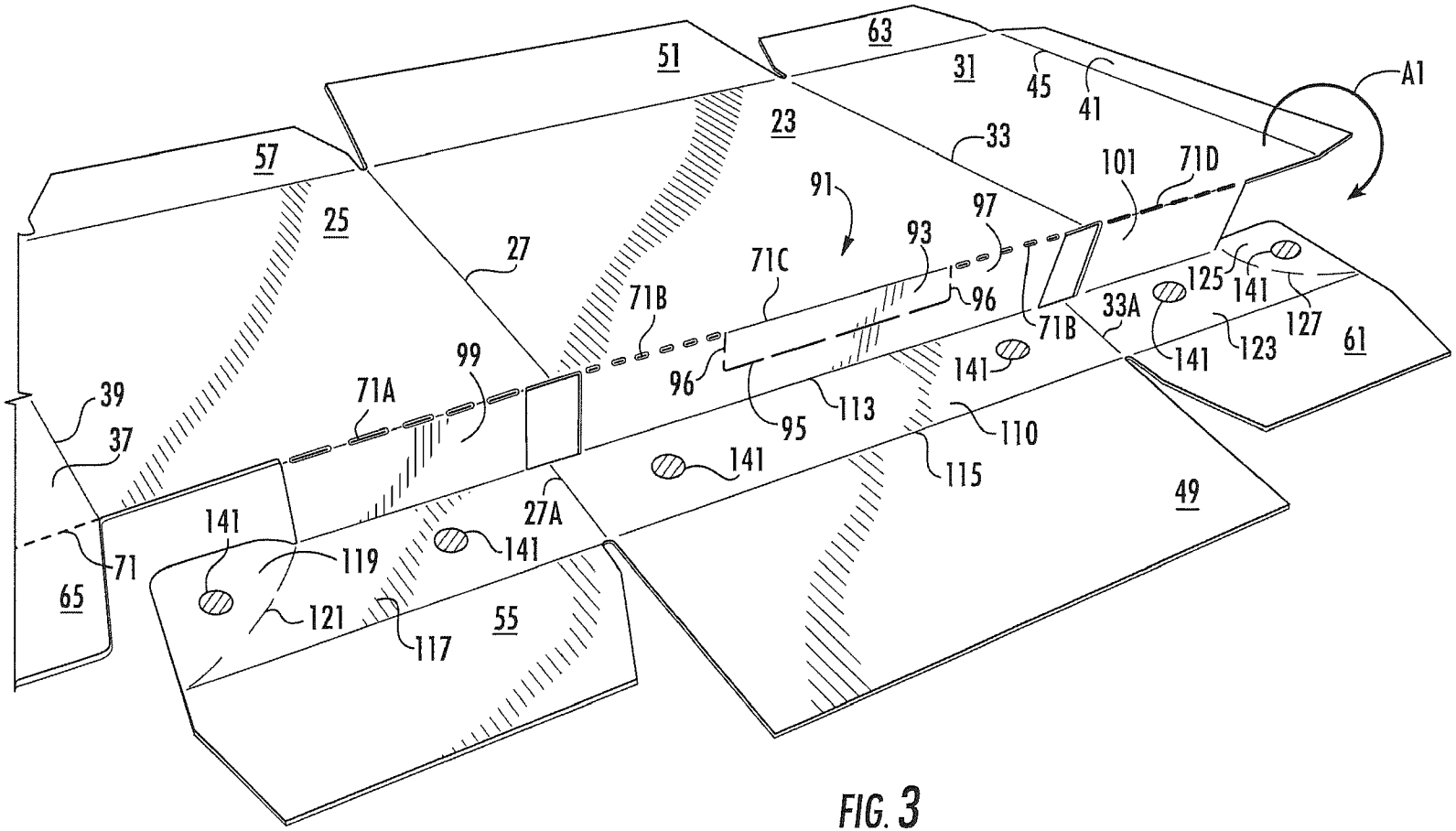
FIG. 3 is a perspective view of the lid features of the blank of FIG. 1 partially folded.
Figure 4:
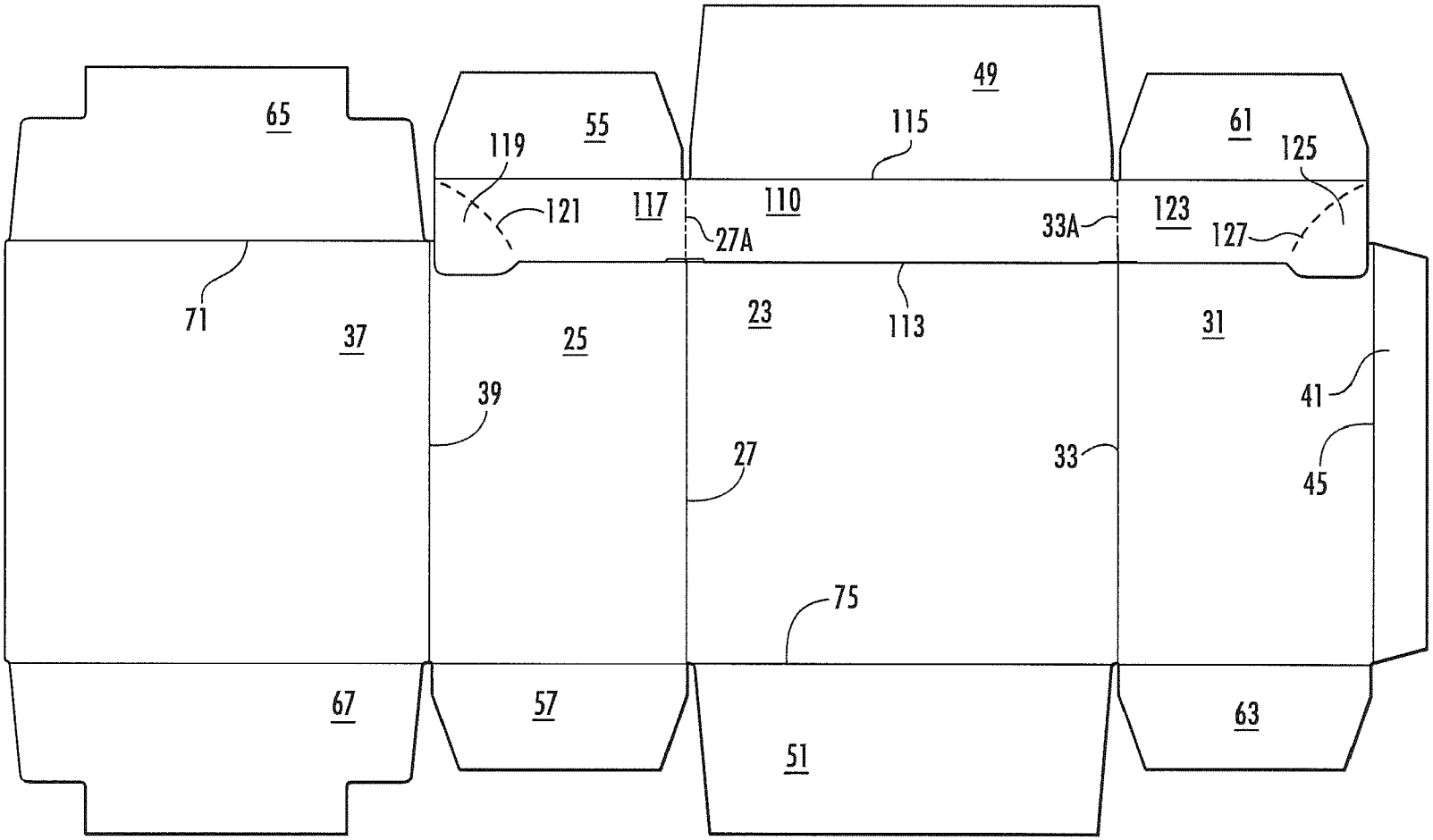
FIG. 4 is a top perspective view of the exterior of the blank of FIG. 1 with the lid features folded.
Figure 5:
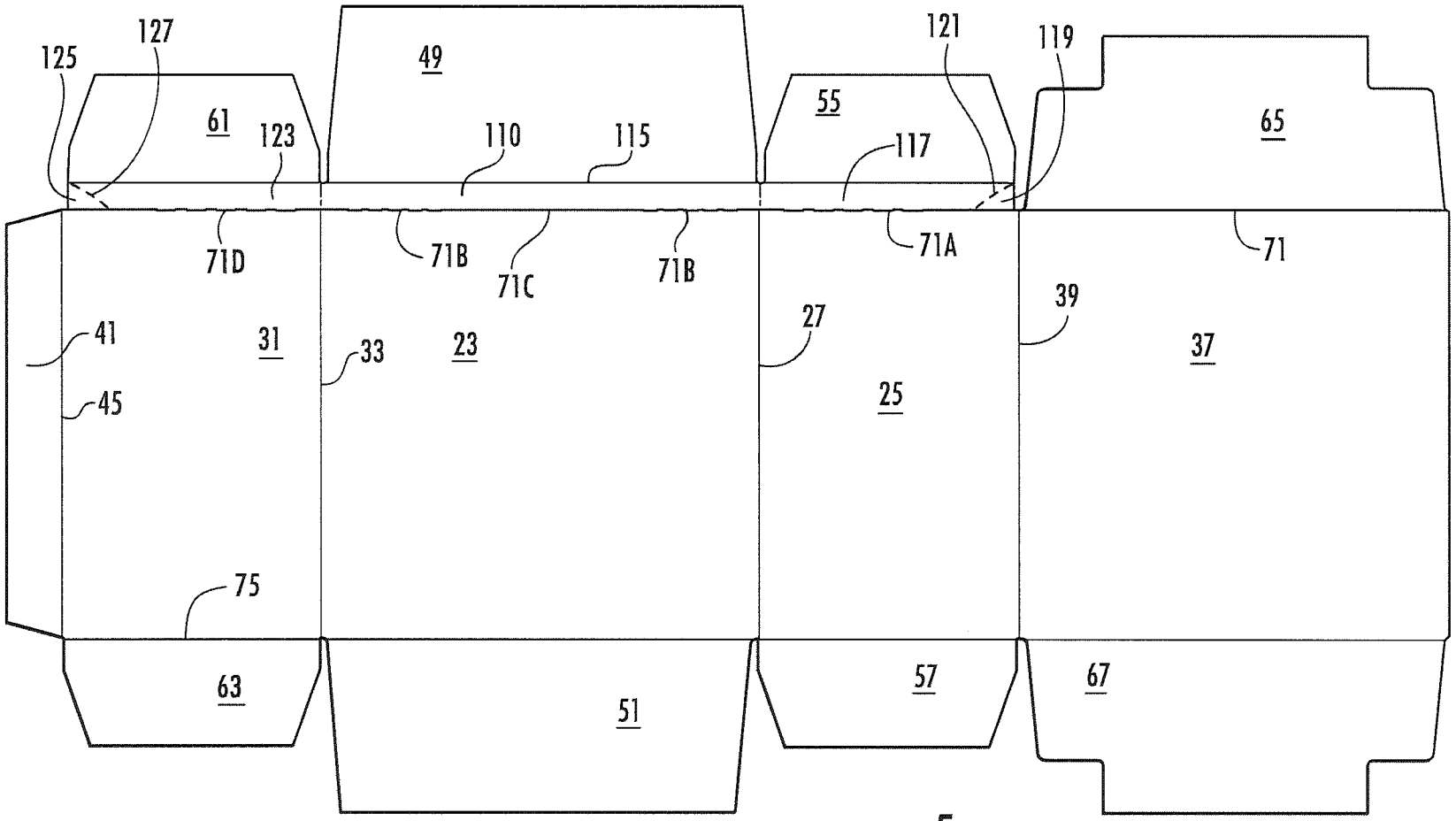
FIG. 5 is a top perspective view of the interior of the blank of FIG. 1 with the lid features folded.

As shown in FIGS. 2-8, and described in the following in accordance with one acceptable example, the carton 5 is formed from the blank 3 through application of glue or adhesive onto areas 141 of the intermediate panels 110, 117, 123 (FIG. 2). Thereafter, the intermediate panels 97, 99, 101 may be folded about fold lines 71A, 71B, 71C, 71D, and 113 in the direction of arrow A1 (FIG. 3) such that the intermediate panels 97, 99, 101 are brought into substantially face-to-face contact with the intermediate panels 110, 117, 123, respectively. This folding sequence may be similar to a z-folding sequence where the corner flap 119 and the associated adhesive region 141 are brought into contact with an exterior surface of the first side panel 25; the second side intermediate panel 117 and the associated adhesive region 141 are brought into contact with an interior surface of the first side intermediate panel 99; the second front intermediate panel 110 and the associated adhesive regions 141 are brought into contact with an interior surface of first front intermediate panel 97; the fourth side intermediate panel 123 and the associated adhesive region 141 are brought into contact with third side intermediate panel 101; and, the corner flap 125 and the associated adhesive region 141 are brought into contact with an exterior surface of the second side panel 31. As shown in FIG. 4, the z-folding sequence brings the longitudinal fold line 115 into substantial registration with the longitudinal fold line 71. As shown in FIG. 5, the tear lines 71A, 71B, and 71D, and the fold line 71C are further in registration with the fold lines 71 and 115 after the z-fold sequence.

Figure 6:
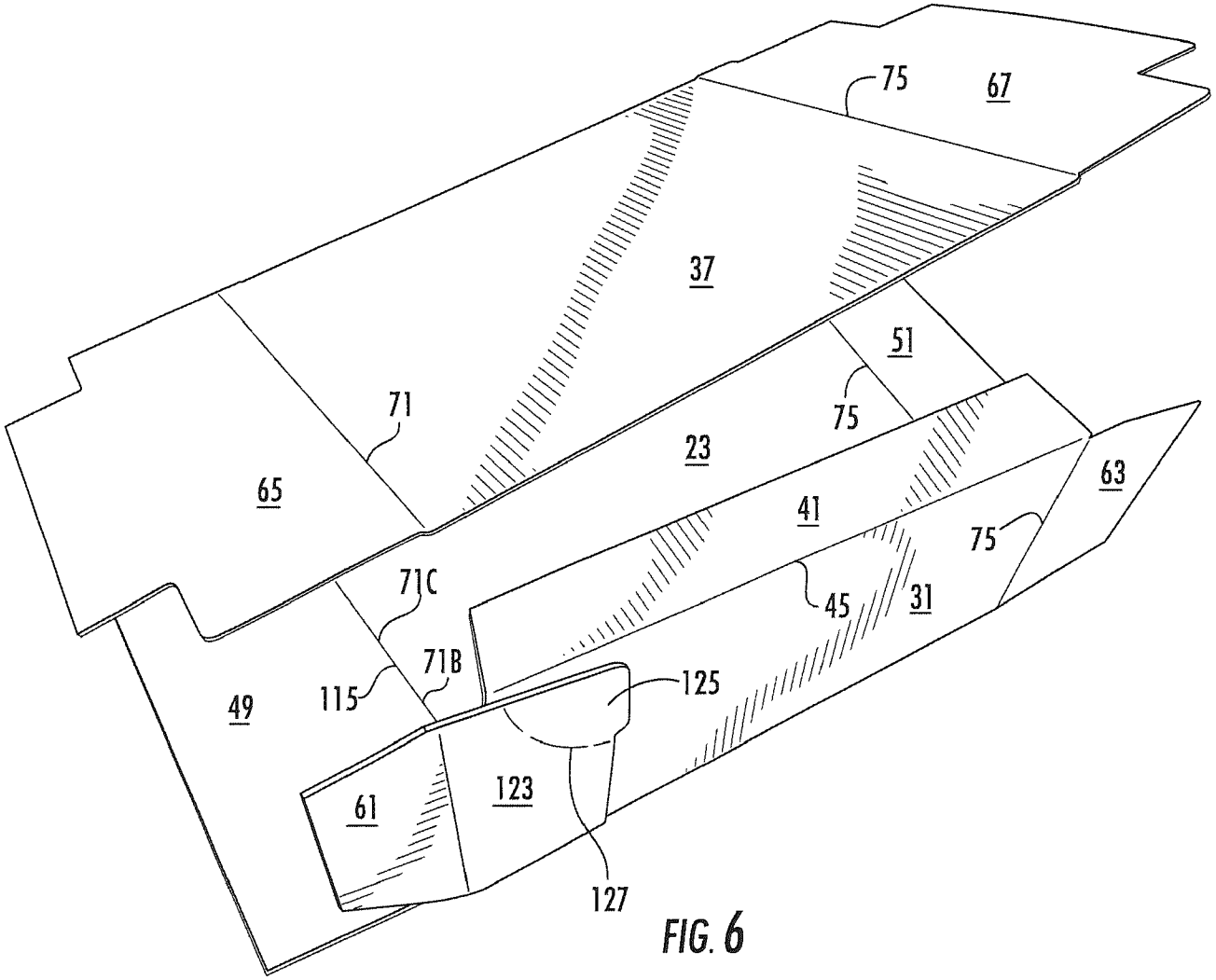
FIG. 6 is a perspective view the blank of FIG. 1 being formed into a sleeve.
Figure 7:
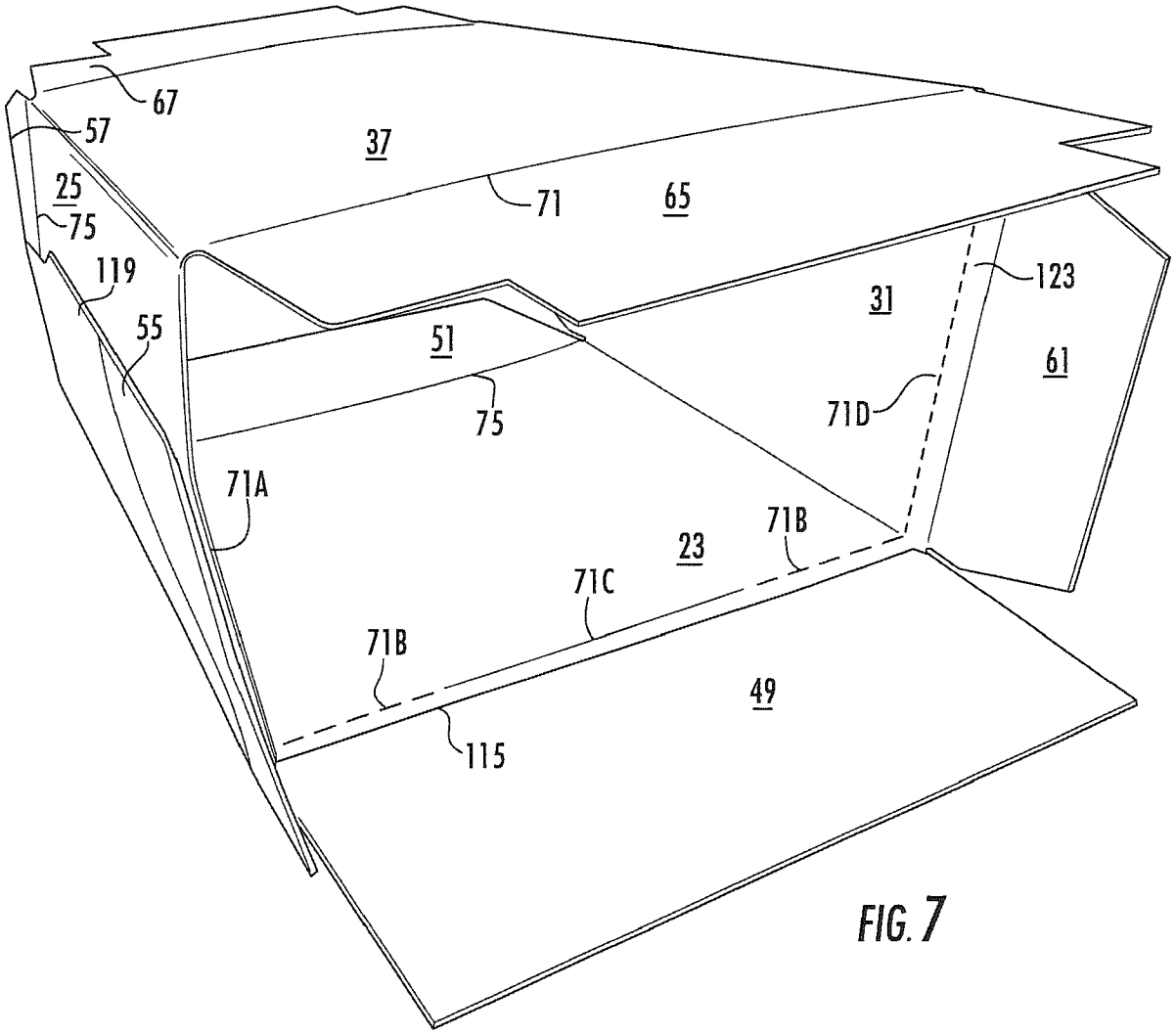
FIG. 7 is a perspective view of a sleeve formed from the blank of FIG. 1

Thereafter, the panels 23, 25, 31, and 37 may be folded to at least partially form an interior 11 of the carton 5, for example, by creation of a sleeve (FIGS. 6-7). The attachment flap 41 may receive adhesive or glue and may be affixed to an interior surface of the back panel 37 (FIG. 6). Upon formation of the sleeve, the ends 68, 69 of the carton 5 may be closed by inwardly folding and attaching the end flaps 49, 55, 61, 65 and 51, 57, 63, 67, respectively. The end flaps 49, 55, 61, 65 and 51, 57, 63, 67 may be attached with glue in some embodiments. The carton may be filled with products to be held therein during any suitable portion of carton formation, for example, through inclusion of a filled liner containing a food product. The filled liner may be adhered or affixed to an interior surface 9 of the carton 5 in some embodiments.

Figure 10:
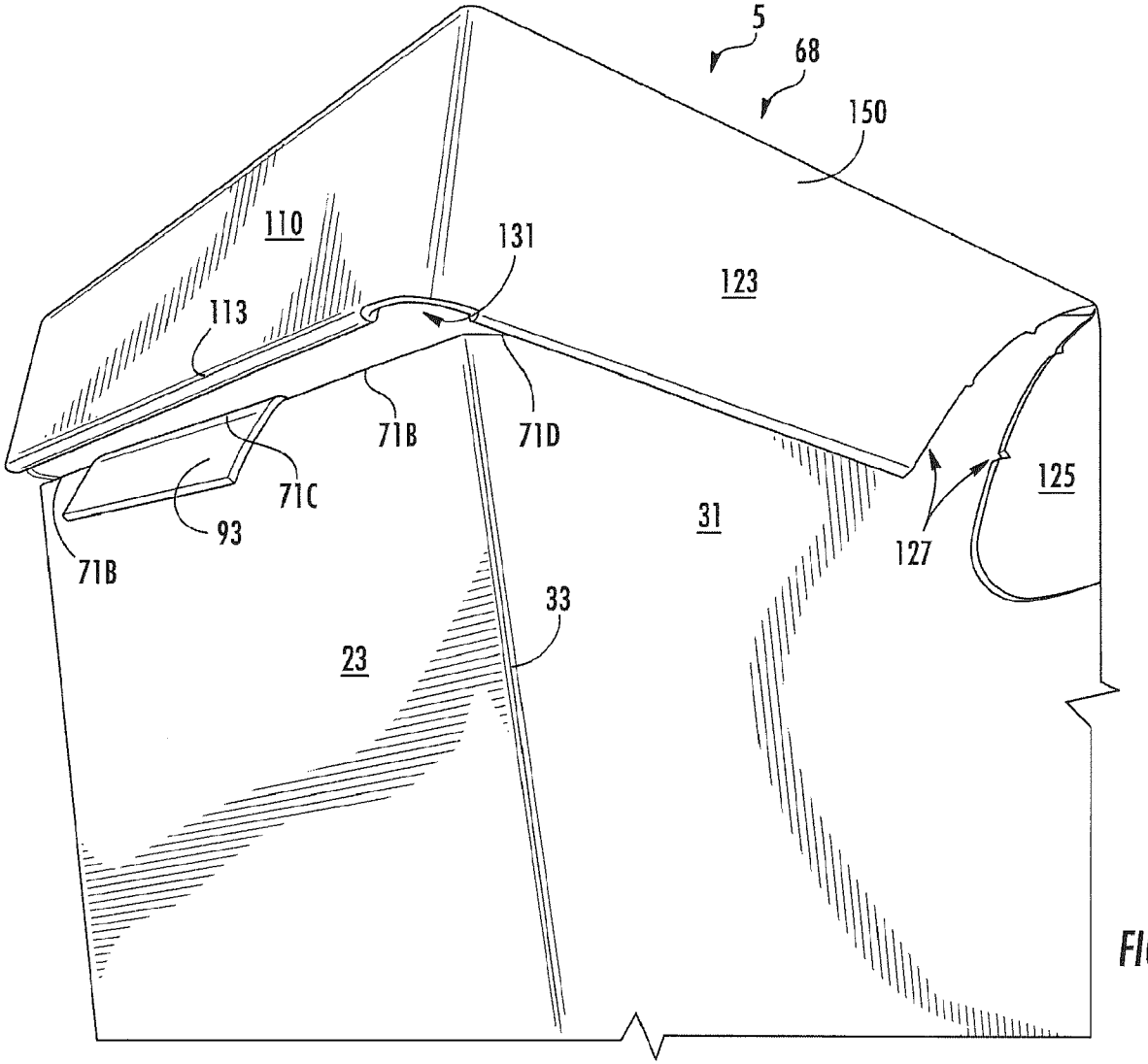
FIG. 10 is a side perspective view of the carton in the open configuration.

As shown in FIG. 10, the lid 150 is formed from lid features 91 during folding of the panels 23, 25, 31, and 37. The lid 150 includes the end flaps 49, 55, 61, and the intermediate panels 97, 99, 101, 110, 117, 123. The fold lines 113, 114, 116 form a bottom edge of the lid 150. The alignment of the fold lines 115, 120, 122 with the fold lines 71, 71C and tear lines 71A, 71B, 71D allows the closing of the carton 5 in conventional seal-end processing equipment that is configured to seal conventional cartons without the above-noted z-fold arrangements of the intermediate panels 97, 99, 101, 110, 117, 123. The lid 150, lid features 91, and associated features may be alternatively shaped, arranged, and/or configured without departing from the scope of this disclosure.

As shown in FIG. 10, the closed end 68 of the carton 5 may be initially opened by activating the lid 150 by separating it from at least a portion of the carton 5 and pivoting the lid 150 about the hinge or fold line 71 to an open position. The lid 150 can be pivoted to the open position by sliding an object (e.g., a finger) beneath edge 113 to detach tear lines 71A, 71B, 71D and arcuate tear lines 121, 127. As shown, the tearing and detaching causes locking tab 93 to remain foldably attached to front panel 23 while lid 150 is formed and hinged upon fold line 71. Thereafter, as shown in FIG. 11, the interior 11 of the carton 5 may be accessed.

To close or reclose the end 68 of the carton 5, the lid 150 may be hinged down about the hinge or fold line 71 into a closed position such that locking tab 93 engages with recess 93A created during opening of the carton 5 (FIG. 11). Thereafter, the carton 5 may be reopened by simply lifting the lid 150, which de-engages the locking tab 93 from recess 93A.

Alternative assembling, loading, closing, opening, reclosing, and/or reopening steps may be used without departing from the scope of the disclosure. For example, the sleeve can be loaded and closed in an automated process, and the ends 68, 69 can be partially closed. Additionally, the carton 5 could be otherwise shaped, arranged, and/or configured without departing from the disclosure. The carton 5 could include various handle features for carrying the carton and could include various dispenser features for opening the carton in manners not herein described. Further the carton 5 could include other panel/flap closing configurations without departing from the disclosure.

Figure 12:
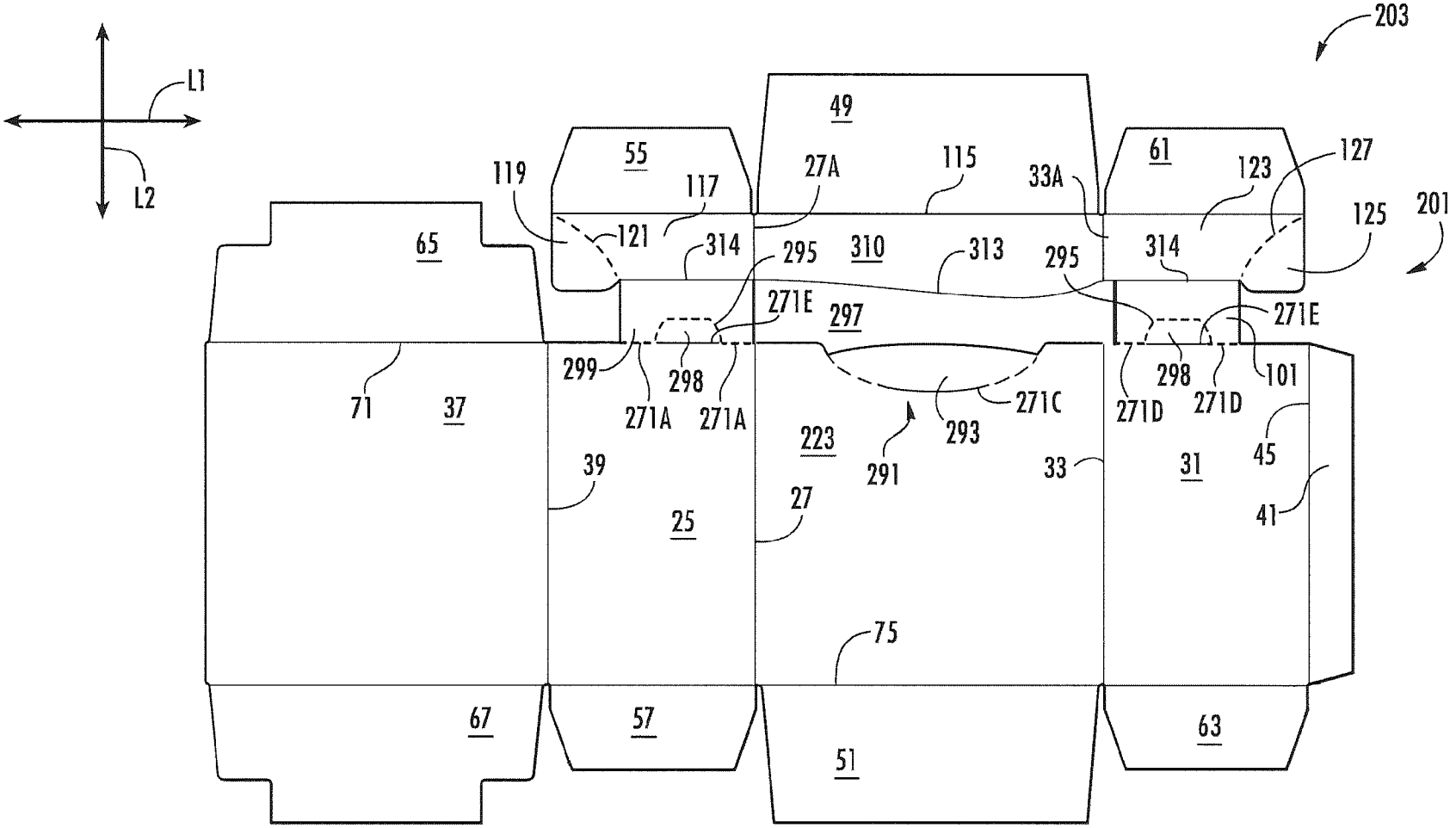
FIG. 12 is an exterior plan view of a blank used to form a carton in accordance with a second embodiment of the disclosure.
Figure 16:
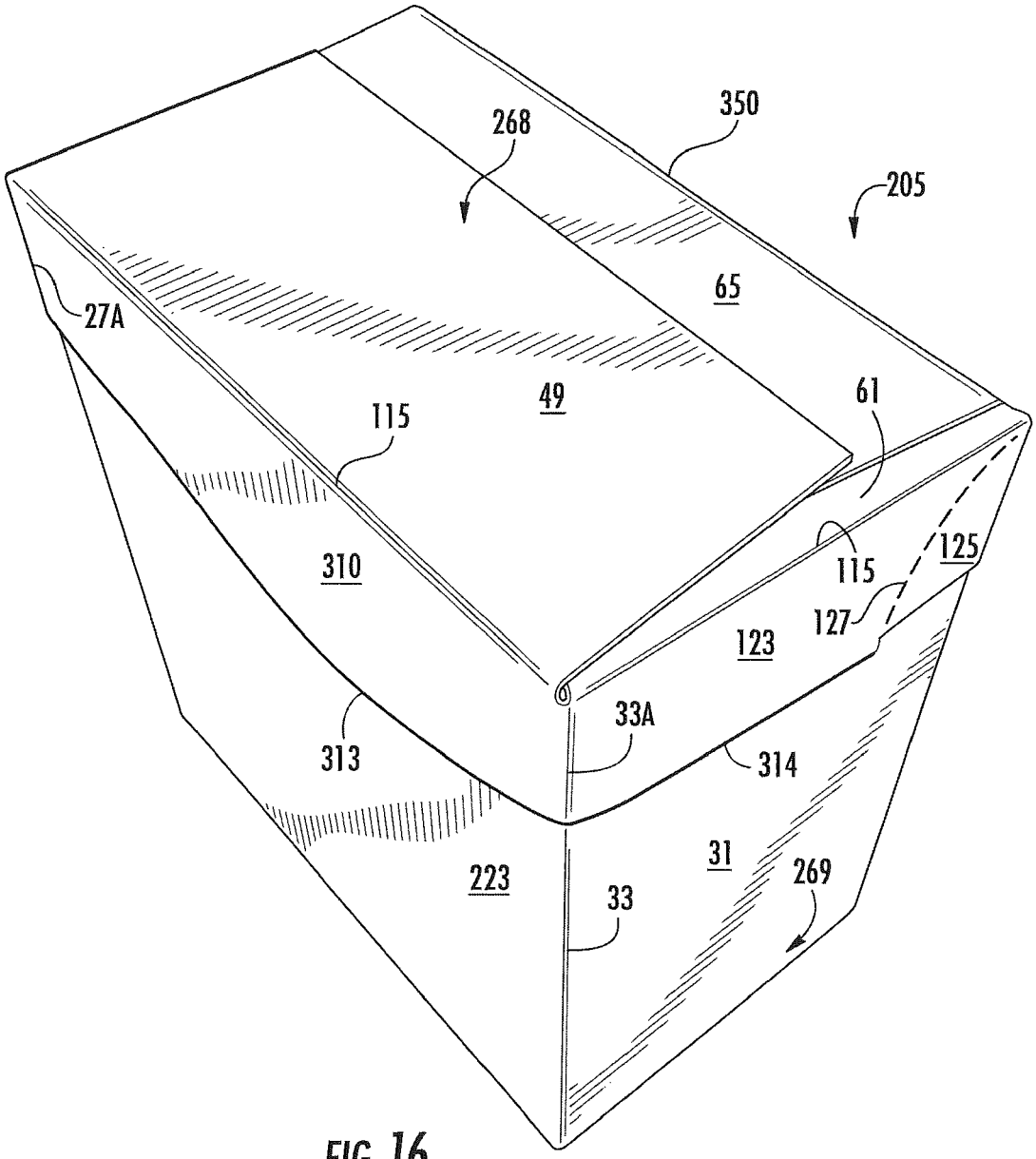
FIG. 16 is a top perspective view of the carton fully assembled.
Figure 18:
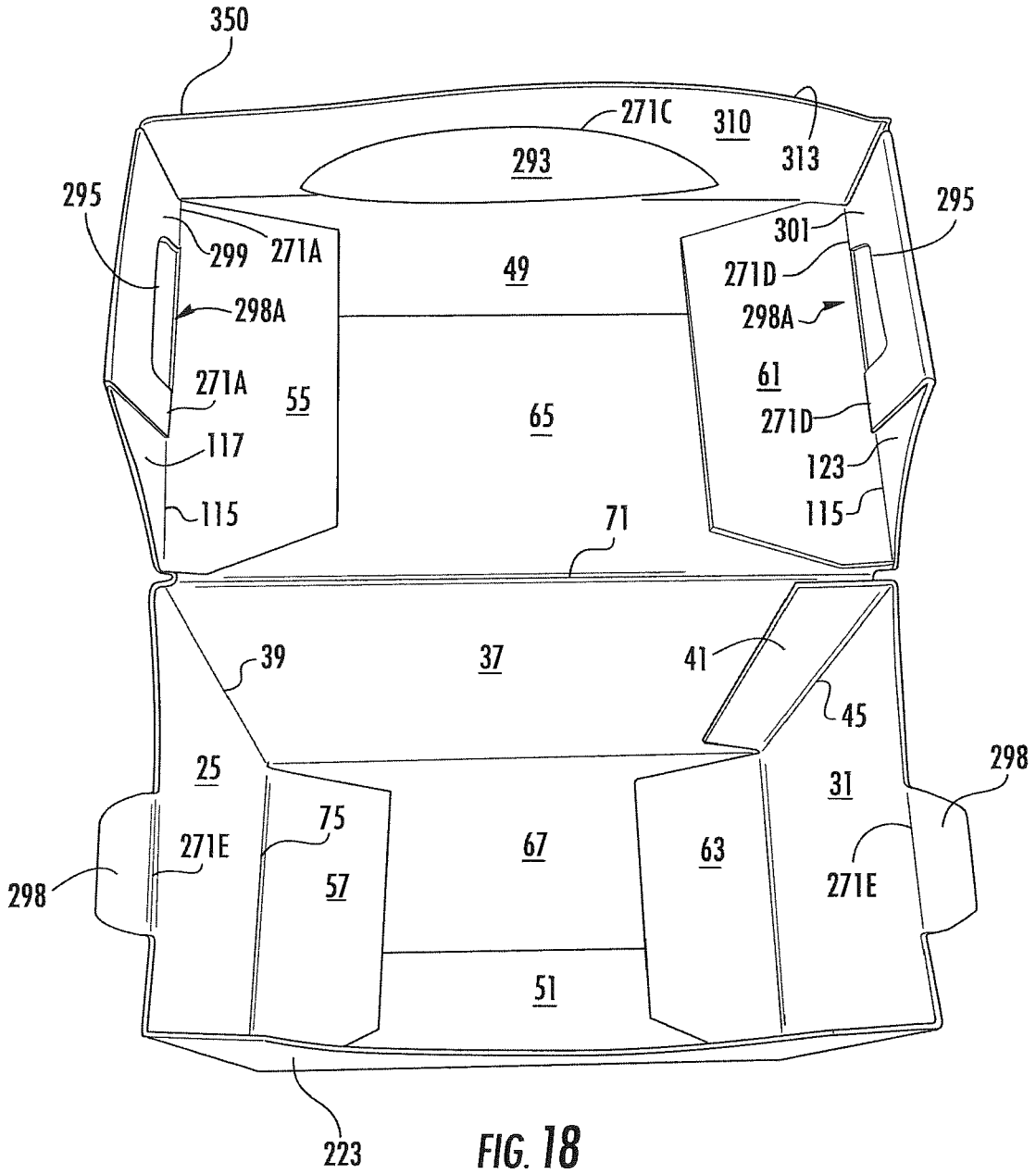

Turning to FIG. 12, a plan view of an exterior surface 201 of a blank 203 used to form a carton 205 (FIG. 16) of a second embodiment of the disclosure is provided. The carton 205 may include a liner, bag, or other construct (not shown) that is in contact with an interior surface 209 of the carton 205 (FIG. 16). The carton 205 may be similar to carton 5, and may be configured to hold a plurality of products as described above. The carton 5 includes a reclosable lid 208 that is pivotable between a closed position (FIG. 16) and an open position (FIG. 18). The carton 205 can include various dispensing features and various opening/closing features without departing from the disclosure.

Figure 17:
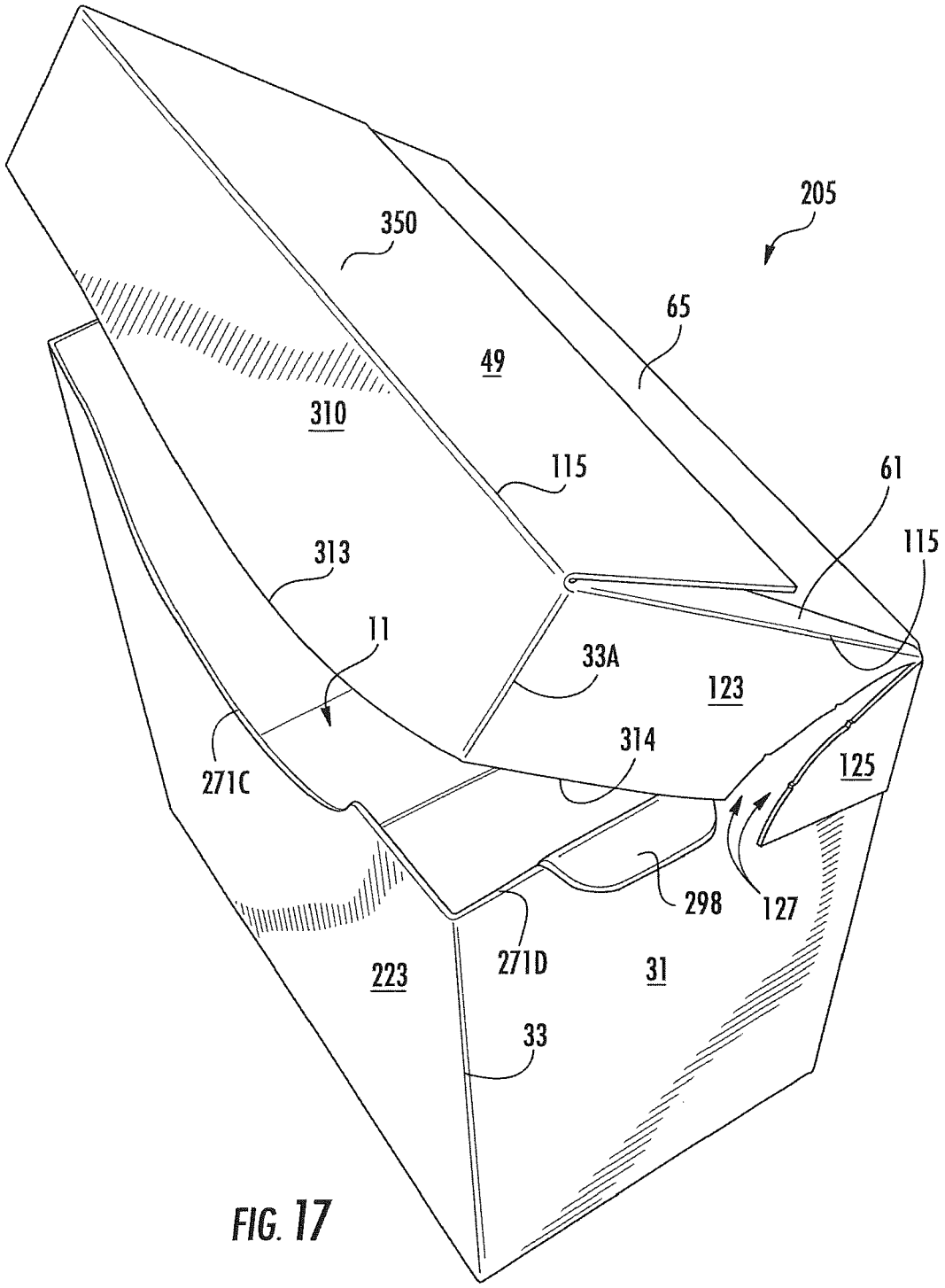
FIGS. 17-18 are a top perspective views of the carton in the open configuration.

Mainly, differences between the blank 203 and the blank 3 include dual-locking tabs 298 and a stylized front edge 313 of a lid 350 (FIG. 17). For example, as shown in FIG. 12, the blank 203 includes a front panel 223 foldably connected to the first side panel 25 and the second side panel 31. In the illustrated embodiment, two end flaps 49, 51 are foldably connected to opposite ends of the front panel 223. Two end flaps 55, 57 are foldably connected to opposite ends of the first side panel 25. Two end flaps 61, 63 are foldably connected to opposite ends of the second side panel 31. Two end flaps 65, 67 are foldably connected to opposite ends of the back panel 37. When the carton 205 is erected, the end flaps 49, 55, 61, 65 close a first (e.g., top) end 268 of the carton, and the end flaps 51, 57, 63, 67 close a second (e.g., bottom) end 269 of the carton (FIG. 16). In accordance with an alternative embodiment of the present disclosure, different panel and flap arrangements can be used for closing the carton 5.

The end flap 65 is foldably connected to the back panel 37 at a first longitudinal fold line 71. The end flaps 51, 57, 63, 67 of the second end 69 are foldably connected at a second longitudinal fold line 75 that extends along the length of the blank. The longitudinal fold lines 71, 75 may be, for example, substantially straight, or offset at one or more locations to account for blank thickness or for other factors. The end flaps 49, 55, 61, 65, 51, 57, 63, 67 can be alternatively shaped, arranged, positioned, and/or omitted without departing from the disclosure.

As shown in FIG. 12, lid features 291 connect the end flaps 49, 55, 61 to a respective one of the panels 23, 25, 31. The lid features 291 are configured to facilitate formation of the reclosable lid 208 of the carton 205. In the illustrated embodiment, the lid features 291 include a front cutout 297 adjacent a first front intermediate panel 310. The lid features 291 further include locking tab 293 in the front panel 223. The locking tab 293 is defined in the front panel 223 by the arcuate tear line 271C which defines a perimeter of the locking tab 293.

The lid features 291 further include a first side intermediate panel 299 foldably connected to the first side panel 25 at tear line 271A. The intermediate panel 299 includes a locking tab 298 foldably connected to the side panel 25 at the longitudinal fold line 271E. The locking tab 298 is defined in the first side intermediate panel 299 by tear lines 295, which define a perimeter of the locking tab 298. A second side intermediate panel 117 is foldably connected to the first side intermediate 299 at a longitudinal fold line 314. The second side intermediate panel 117 is foldably connected to the first front intermediate panel 310 at a lateral fold line 27A. The second side intermediate panel 117 is foldably connected to the end flap 55 at longitudinal fold line 120. The second side intermediate panel 117 includes a corner portion 119 defined by a tear line 121. In the illustrated embodiment, the end flap 55 is connected to the first side panel 25 by the lid features 291 that include the first side intermediate panel 299 and the second side intermediate panel 117.

In the embodiment of FIG. 12, the end flap 61 is connected to the second side panel 31 by similar lid features 291 that connect the end flap 55 and the first side panel 25. For example, the lid features 291 include a third side intermediate panel 301 foldably connected to the second side panel 31 at a tear lines 271D. The intermediate panel 301 includes an additional locking tab 298 foldably connected to the side panel 31 at the longitudinal fold line 271E. The locking tab 298 is defined in the third side intermediate panel 301 by tear lines 295, 296, which define a perimeter of the locking tab 298. A fourth side intermediate panel 123 is foldably connected to third side intermediate panel 301 at a longitudinal fold line 116. The fourth side intermediate panel 123 is foldably connected to the first front intermediate panel 310 at a lateral fold line 33A. The fourth side intermediate panel 123 is foldably connected to the end flap 61 at a longitudinal fold line 122. The fourth side intermediate panel 123 includes a corner portion 125 defined by a tear line 127. In the illustrated embodiment, the end flap 61 is foldably connected to the second side panel 31 by the lid features 291 that include the third intermediate side panel 301 and the fourth intermediate side panel 123. The lid features 291 can be otherwise shaped, arranged, and/or configured without departing from the scope of this disclosure.

Figure 13:
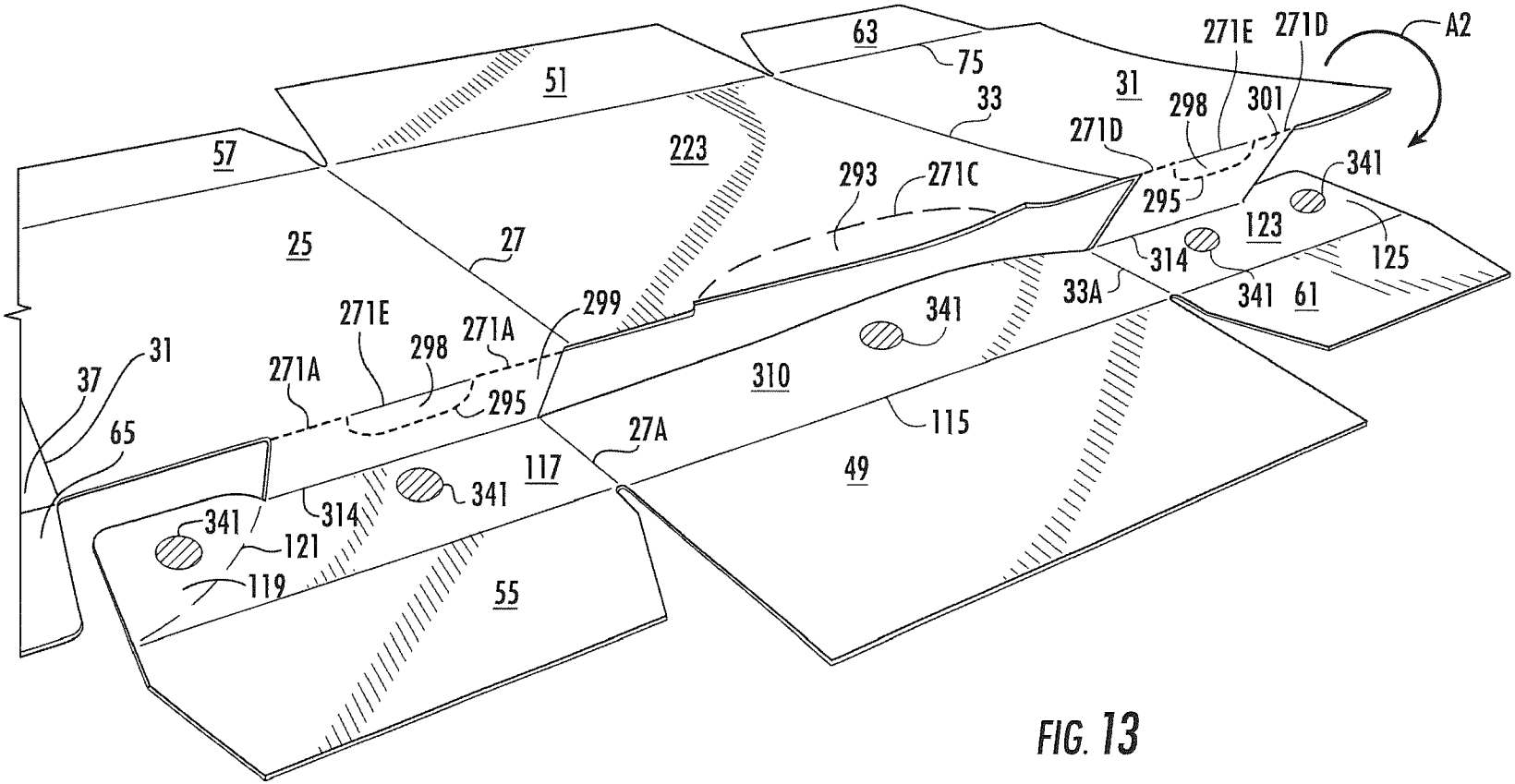
FIG. 13 is a perspective view of the lid features of the blank of FIG. 12 partially folded.
Figure 14:
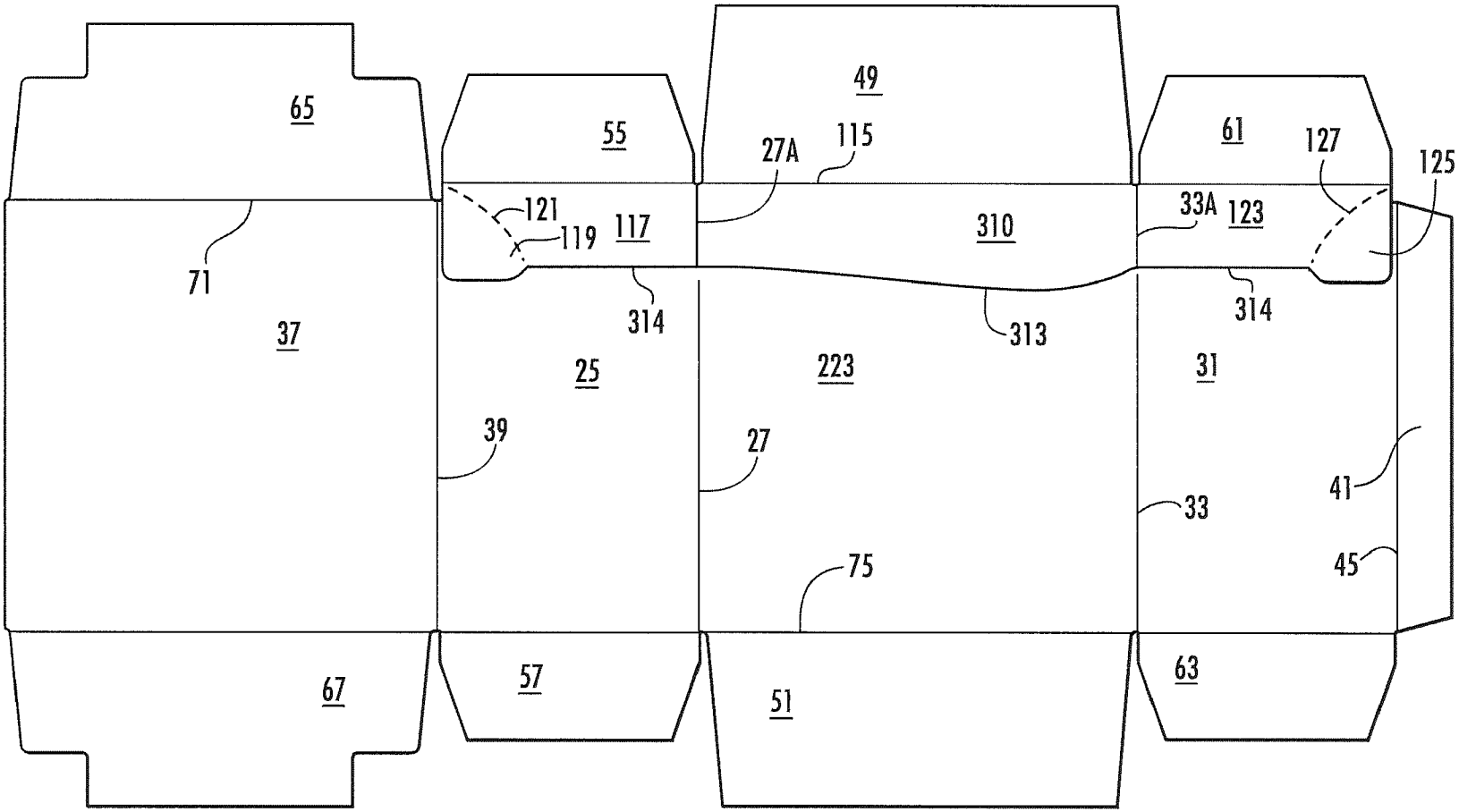
FIG. 14 is a top perspective view of the exterior of the blank of FIG. 12 with the lid features folded.

As shown in FIGS. 13-20, and described in the following in accordance with one acceptable example, the carton 205 is formed from the blank 203 through application of glue or adhesive onto the areas 341 of the intermediate panels 310, 117, 123 (FIG. 13). Thereafter, the intermediate panels 299, 301 may be folded about fold lines 271A, 271B, 271C, 271D, and 313 in the direction of arrow A2 (FIG. 13) such that the intermediate panels 299, 301 are brought into substantially face-to-face contact with the intermediate panels 117, 123, respectively. This folding sequence may be similar to a z-folding sequence where the corner flap 119 and the associated adhesive region 341 are brought into contact with an exterior surface of the first side panel 25; the second side intermediate panel 117 and the associated adhesive region 341 are brought into contact with an interior surface of the first side intermediate panel 299; the first front intermediate panel 310 and the associated adhesive region 341 are brought into contact with an exterior surface of the locking tab 293; the fourth side intermediate panel 123 and the associated adhesive region 341 are brought into contact with the intermediate side panel 301; and, the corner flap 125 and the associated adhesive region 341 are brought into contact with an exterior surface of the second side panel 31. As shown in FIG. 14, the z-folding sequence brings longitudinal fold line 115 into substantial registration with longitudinal fold line 71.

Figure 15:
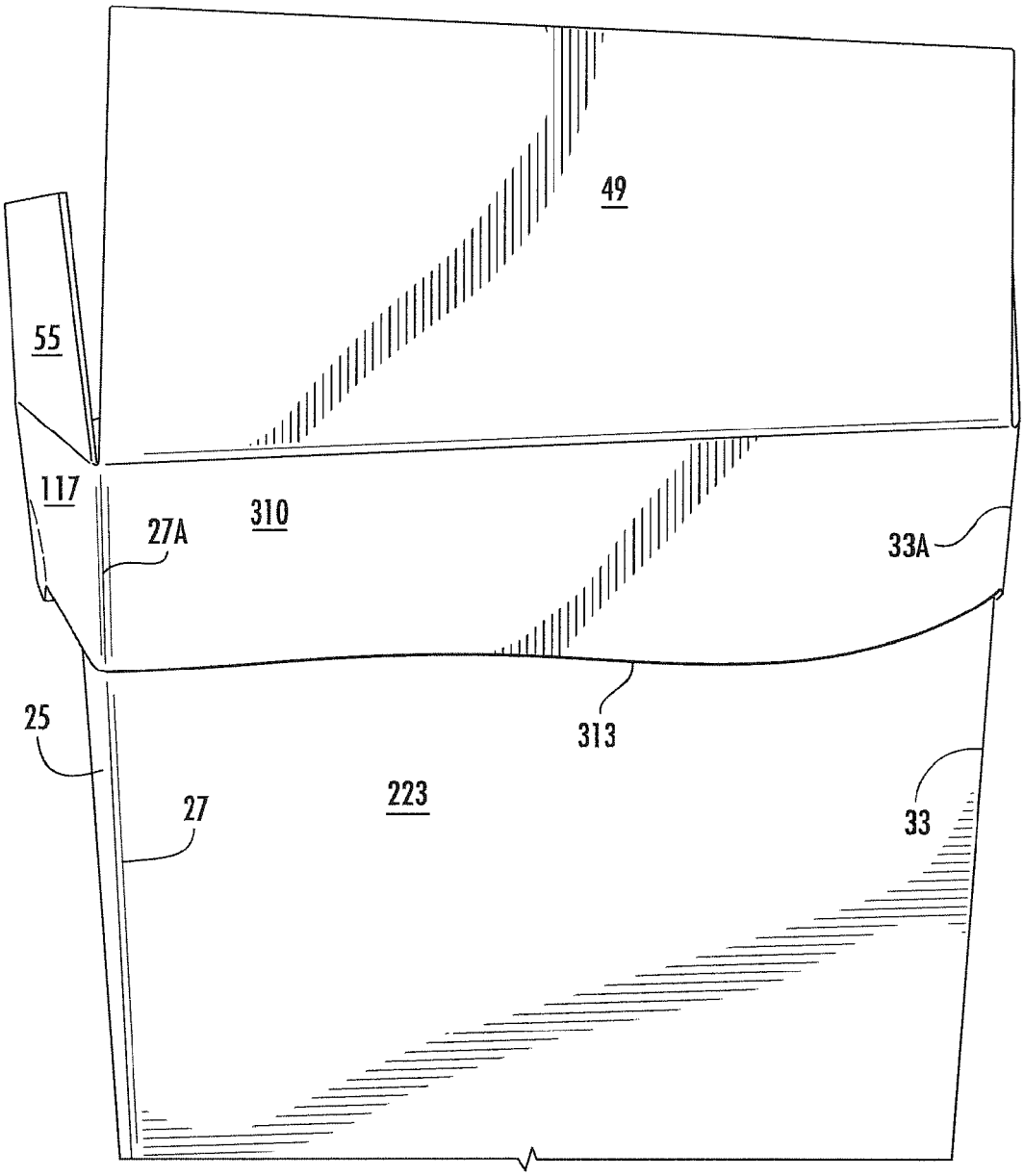
FIG. 15 is a side perspective view of the carton partially formed from the blank of FIG. 12.

Thereafter, the panels 23, 25, 31, and 37 may be folded to at least partially form an interior 11 of the carton 205, for example, by creation of a sleeve (FIG. 15). The attachment flap 41 may receive adhesive or glue and may be affixed to an interior surface of the back panel 37. Upon formation of the sleeve, the ends 268, 269 of the carton 205 may be closed by inwardly folding and attaching the end flaps 49, 55, 61, 65 and 51, 57, 63, 67, respectively. The end flaps 49, 55, 61, 65 and 51, 57, 63, 67 may be attached with glue in some embodiments. The carton may be filled with products to be held therein during any suitable portion of carton formation, for example, through inclusion of a filled liner containing a food product. The filled liner may be adhered or affixed to an interior surface 9 of the carton 5 in some embodiments.

As shown in FIGS. 15-16, the lid 350 is formed from lid features 291 during folding of the panels 223, 25, 31, and 37. The lid 350 includes the end flaps 49, 55, 61, and the intermediate panels 299, 301, 310, 117, 123. The edge 313 and the fold lines 114, 116 form a bottom edge of the lid 350. The alignment of the fold lines 115, 120, 122 with the fold lines 271E and tear lines 271A, 271D allows the closing of the carton 205 in conventional seal-end processing equipment that is configured to seal conventional cartons without the above-noted z-fold arrangements of the intermediate panels 299, 301, 310, 117, 123. The lid 350, lid features 291, and associated features may be alternatively shaped, arranged, and/or configured without departing from the scope of this disclosure.

Figure 19:
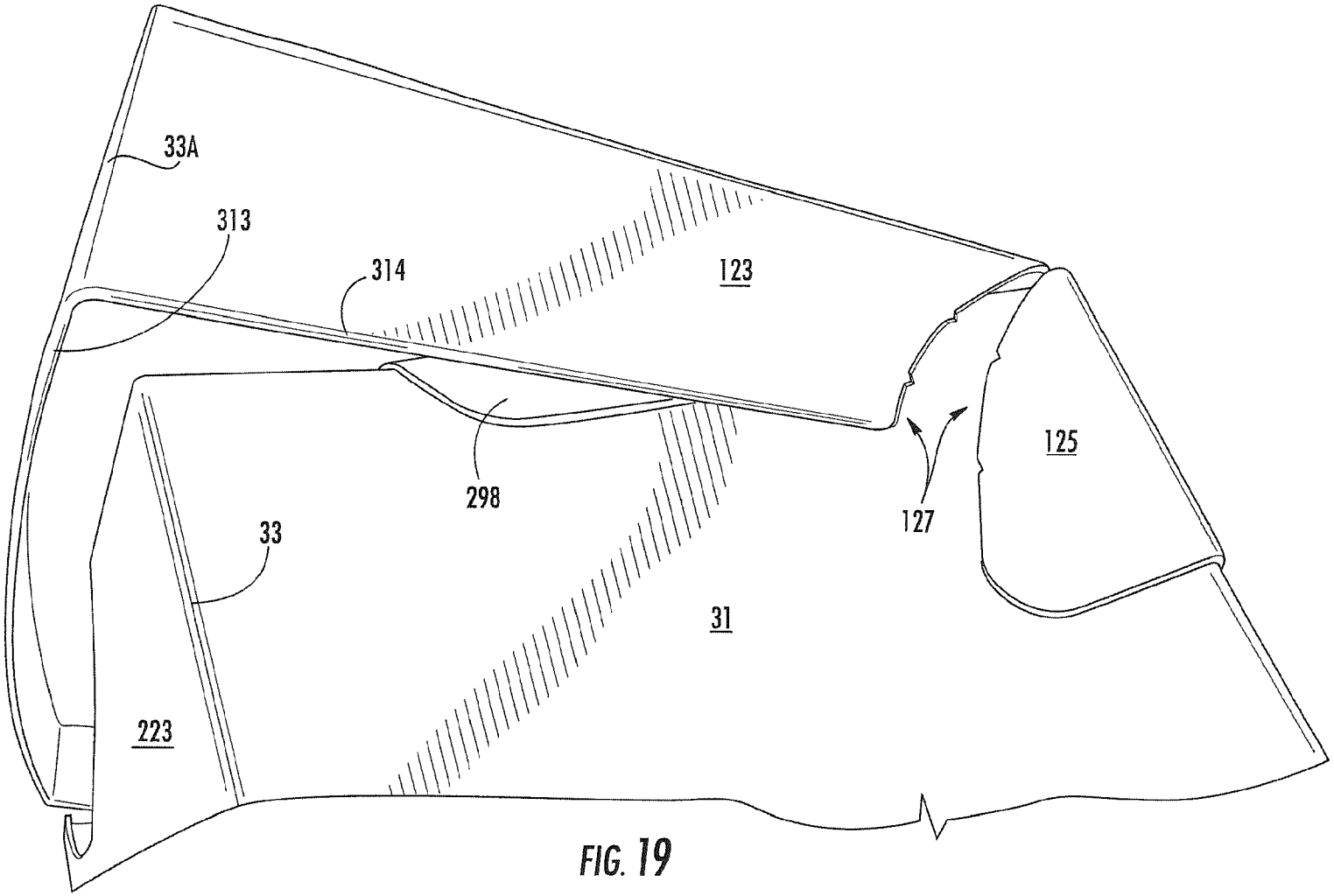
FIGS. 19-20 are side perspective views of the carton in the open configuration.

As shown in FIGS. 16-17, the closed end 268 of the carton 205 may be initially opened by activating the lid 350 by separating it from at least a portion of the carton 205 and pivoting the lid to an open position. The lid 350 can be pivoted to the open position by sliding an object (e.g., a finger) beneath edges 313, 314 to detach tear lines 271A, 271C, 271D and arcuate tear lines 121, 127. As shown, the tearing and detaching causes locking tabs 298 to remain foldably attached to side panels 25, 31 while lid 350 is formed hinged upon fold line 71. Thereafter, as shown in FIGS. 18-20, the interior 11 of the carton 205 may be accessed.

Figure 20:
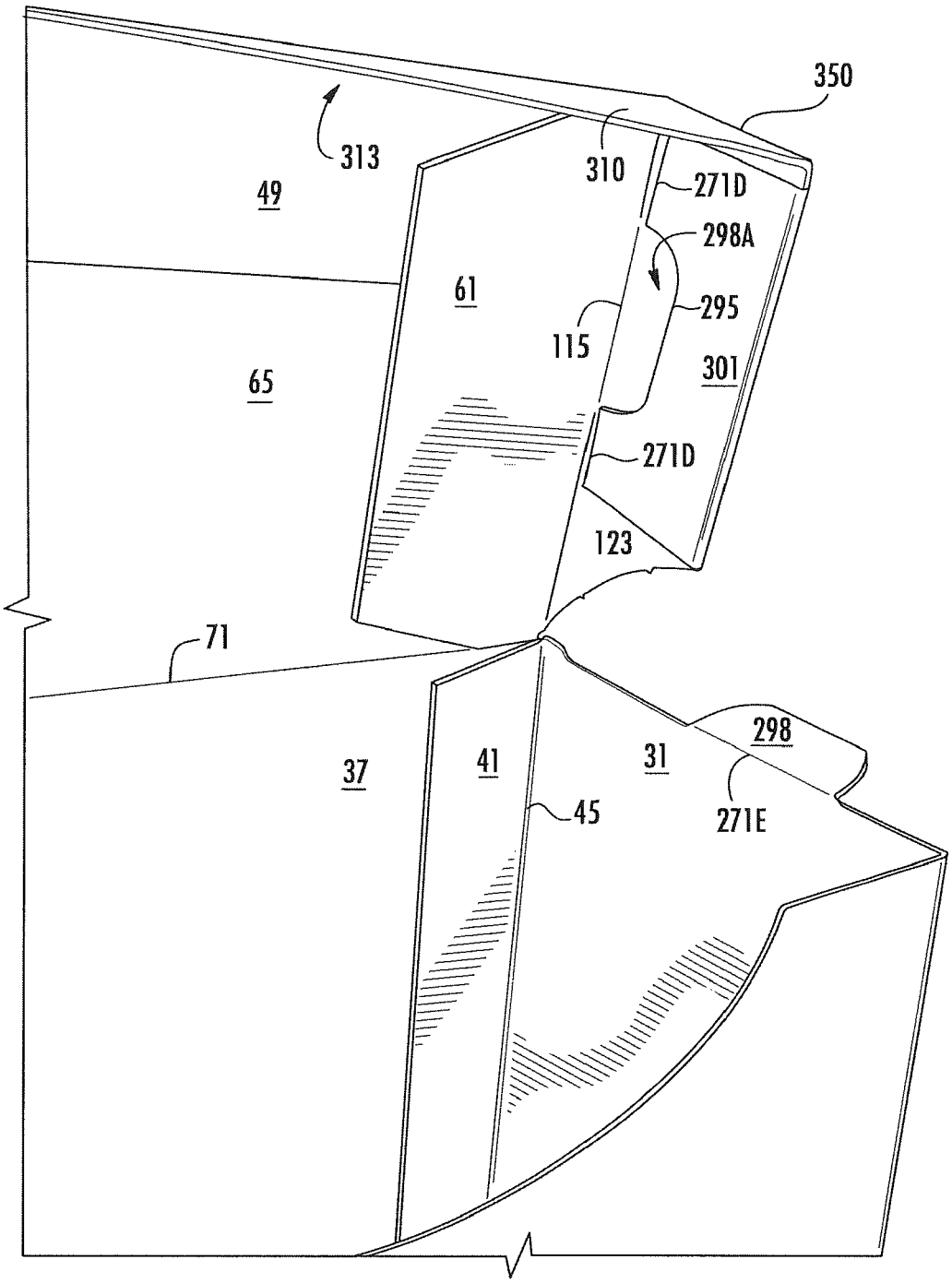

To close or reclose the end 268 of the carton 205, the lid 350 may be hinged down such that locking tabs 298 engage with recesses 298A created during opening of the carton 205 (FIGS. 18 and 20). Thereafter, the carton 205 may be reopened by simply lifting the lid 350, which de-engages the locking tabs 298 from recesses 298A.

Alternative assembling, loading, closing, opening, re-closing, and/or re-opening steps may be used without departing from the scope of the disclosure. Additionally, the carton 205 could be otherwise shaped, arranged, and/or configured without departing from the disclosure. The carton 205 could include various handle features for carrying the carton and could include various dispenser features for opening the carton in manners not herein described. Further the carton 205 could include other panel/flap closing configurations without departing from the disclosure.

Figure 21:
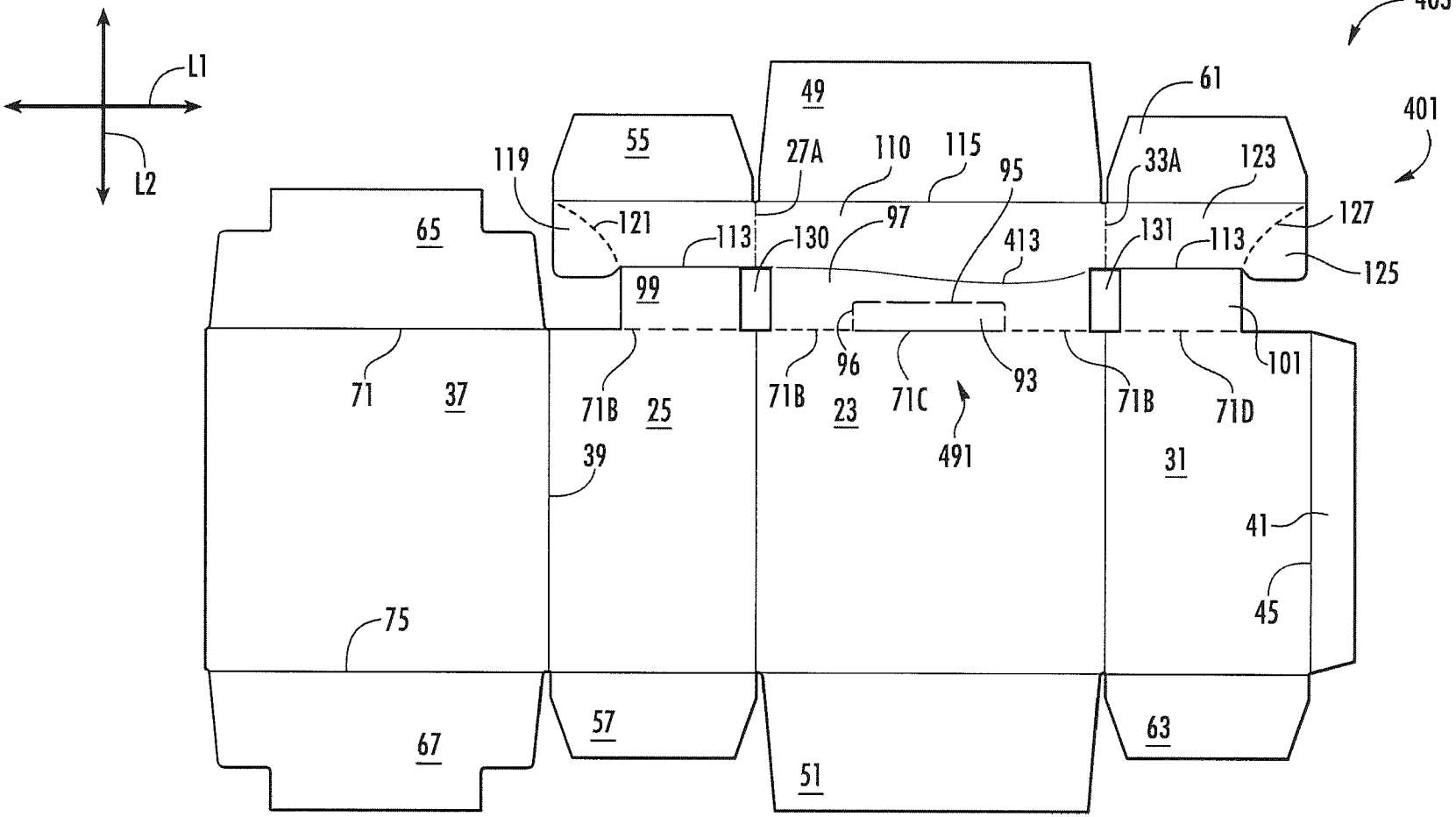
FIG. 21 is an exterior plan view of a blank used to form a carton in accordance with a third embodiment of the disclosure.

Turning to FIG. 21, a plan view of an exterior surface 401 of a blank 403 used to form a carton of a third embodiment of the disclosure is provided. The blank 403 is substantially similar to blank 3, with the inclusion of a curved tear line 413 instead of a straight fold line 113 across the intermediate front panels 97, 110. The curved tear line 413 allows for a stylized frontal exterior edge of a lid 150 of the opening/closing features 491 while retaining a single locking tab 93.

Figure 22:
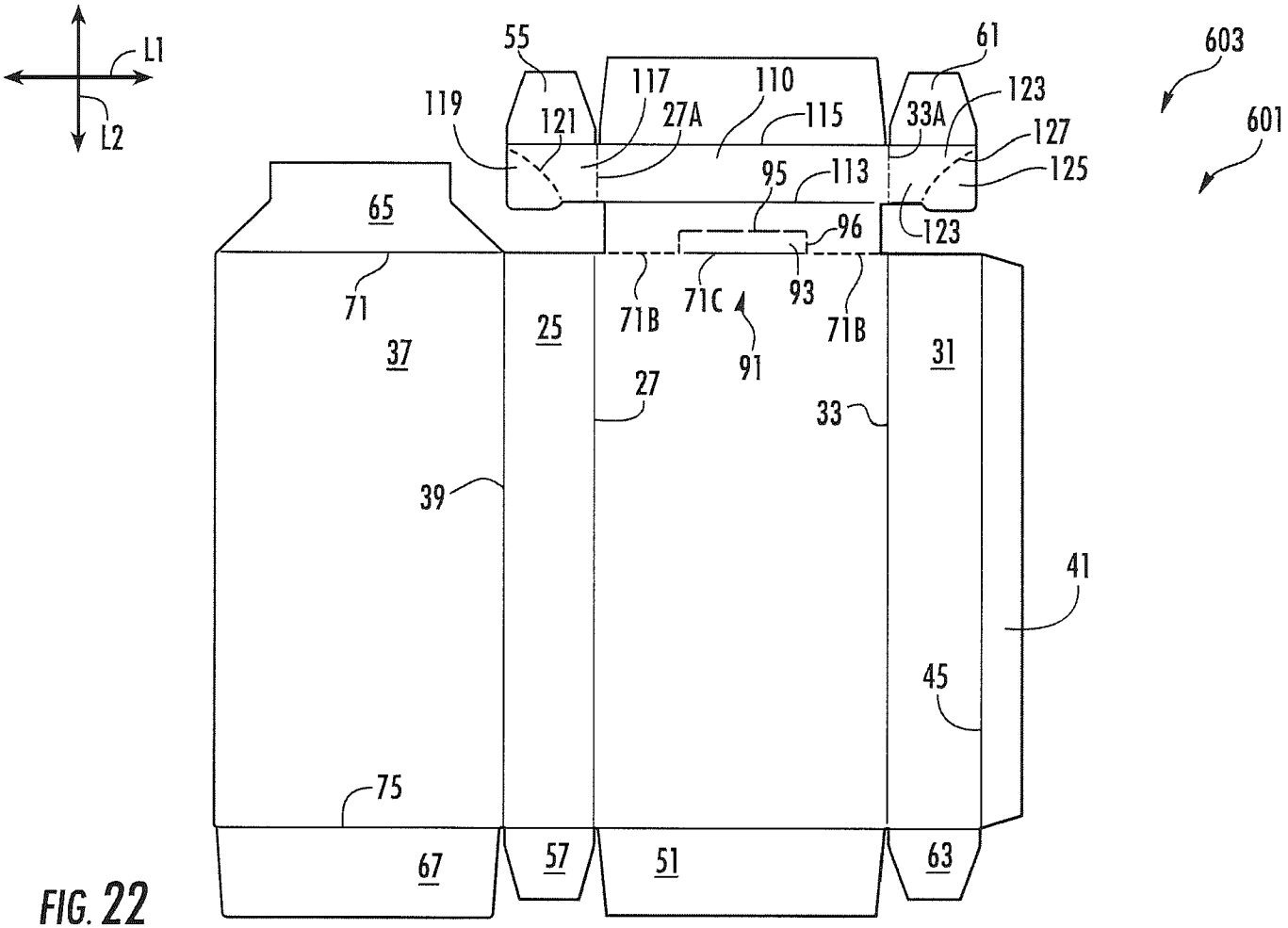
FIG. 22 is an exterior plan view of a blank used to form a carton in accordance with a fourth embodiment of the disclosure.

Turning to FIG. 22, a plan view of an exterior surface 601 of a blank 603 used to form a carton of a fourth embodiment of the disclosure is provided. The blank 603 is substantially similar to blank 3, being modified to lack first and second intermediate side panels and being of differing height/longitudinal dimensions.

The cartons 5, 205, and the blanks 3, 203, 403, 603, are shown and described by way of example. Any of the features of the various embodiments of the disclosure can be combined with, replaced by, or otherwise configured with other features of other embodiments of the disclosure without departing from the scope of this disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, kraft lined paperboard, double kraft lined paperboard, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding and dispensing a product, the carton comprises:

a plurality of panels that extends at least partially around an interior of the carton, the plurality of panels comprise a front panel, a back panel, a first side panel, and a second side panel;

a hinge in at least one of the plurality of panels;

a reclosable lid pivotably attached to the carton, the reclosable lid comprises a first intermediate panel removably connected to the front panel along a first tear line, a second intermediate panel foldably connected to the first intermediate panel along a first fold line, a third intermediate panel removably connected to the first side panel along a second tear line, and a fourth intermediate panel foldably connected to the third intermediate panel along a second fold line, the first intermediate panel is positioned in face-to-face contact with the second intermediate panel and the third intermediate panel is positioned in face-to-face contact with the fourth intermediate panel; and the reclosable lid is pivotable at the hinge between a closed position preventing access to the interior of the carton and an open position allowing access to the interior of the carton; and wherein the fourth intermediate panel includes a first corner portion defined by a tear line extending from the second fold line and at least a portion of the first corner portion is in face-to-face contact with the first side panel.

2. The carton of claim 1, wherein the reclosable lid comprises a fifth intermediate panel removably connected to the second side panel along a third tear line and a sixth intermediate panel foldably connected to the fifth intermediate panel along a third fold line, the fifth intermediate panel is positioned in face-to-face contact with the sixth intermediate panel.

3. The carton of claim 2, wherein the sixth intermediate panel includes a second corner portion defined by a tear line extending from the third fold line and at least a portion of the second corner portion is in face-to-face contact with the second side panel.

4. The carton of claim 2 further comprises a plurality of end flaps, the plurality of end flaps are configured to close a first end of the carton, the end flaps comprises a first end flap foldably connected to the front panel, a second end flap foldably connected to the first side panel, a third end flap foldably connected to the second side panel, and a fourth end flap foldably connected to the back panel.

5. The carton of claim 4, wherein the first end flap is foldably connected to the front panel by the first intermediate panel and the second intermediate panel.

6. The carton of claim 5, wherein the second end flap is foldably connected to the first side panel by the third intermediate panel and the fourth intermediate panel.

7. The carton of claim 6, wherein the third end flap is foldably connected to the second side panel by the fifth intermediate panel and the sixth intermediate panel.

8. The carton of claim 7, wherein the fourth end flap is foldably connected to the back panel at a fold line.

9. The carton of claim 8, wherein the reclosable lid comprises the plurality of end flaps and the hinge comprises the fold line.

10. The carton of claim 2, wherein a first cutout separates the third intermediate panel from the first intermediate panel and a second cutout separates the fifth intermediate panel from the first intermediate panel.

11. The carton of claim 1, wherein the lid features comprise a locking tab defined by at least one tear line in the first intermediate panel and the locking tab is foldably connected to the front panel.

12. The carton of claim 1, wherein the first fold line is substantially straight.

13. The carton of claim 1, wherein the first fold line is curved.

14. A carton for holding and dispensing a product, the carton comprises:

a plurality of panels that extends at least partially around an interior of the carton, the plurality of panels comprise a front panel, a back panel, a first side panel, and a second side panel;

a hinge in at least one of the plurality of panels;

a reclosable lid pivotably attached to the carton, the reclosable lid comprises a first intermediate panel removably connected to the first side panel along a first tear line, a second intermediate panel foldably connected to the first intermediate panel along a first fold line, a third intermediate panel removably connected to the second side panel along a second tear line, and a fourth intermediate panel foldably connected to the third intermediate panel along a second fold line, the first intermediate panel is positioned in face-to-face contact with the second intermediate panel and the third intermediate panel is positioned in face-to-face contact with the fourth intermediate panel; and the reclosable lid is pivotable at the hinge between a closed position preventing access to the interior of the carton and an open position allowing access to the interior of the carton; and wherein the second intermediate panel includes a first corner portion defined by a tear line extending from the first fold line and at least a portion of the first corner portion is in face-to-face contact with the first side panel.

15. The carton of claim 14, wherein the reclosable lid comprises a fifth intermediate panel foldably connected to the second intermediate panel and the fourth intermediate panel.

16. The carton of claim 15, wherein a cutout separates the first intermediate panel from the third intermediate panel and the fifth intermediate panel from the front panel.

17. The carton of claim 16, wherein the carton comprises a locking tab defined by at least one tear line in the front panel, the locking tab is adjacent the cutout.

18. The carton of claim 17, wherein the locking tab is a first locking tab, the carton comprises a second locking tab foldably connected to the first side panel and defined by a tear line in the first intermediate panel and a third locking tab foldably connected to the second side panel and defined by a tear line in the third intermediate panel.

19. The carton of claim 15 further comprises a plurality of end flaps, the plurality of end flaps are configured to close a first end of the carton, the end flaps comprises a first end flap foldably connected to the front panel, a second end flap foldably connected to the first side panel, a third end flap foldably connected to the second side panel, and a fourth end flap foldably connected to the back panel.

20. The carton of claim 19, wherein the second end flap is foldably connected to the first side panel by the first intermediate panel and the second intermediate panel, the third end flap is foldably connected to the second side panel by the third intermediate panel and the fourth intermediate panel.

21. The carton of claim 20, wherein the first end flap is foldably connected to the front panel by the fifth intermediate panel.

22. The carton of claim 21, wherein the fourth end flap is foldably connected to the back panel at a fold line, and the reclosable lid comprises the end flaps and the hinge comprises the fold line.

23. A carton for holding and dispensing a product, the carton comprises:

a plurality of panels that extends at least partially around an interior of the carton, the plurality of panels comprise a front panel, a back panel, a first side panel, and a second side panel;

a hinge in at least one of the plurality of panels;

a reclosable lid pivotably attached to the carton, the reclosable lid comprises a first intermediate panel removably connected to the front panel along a first tear line, a second intermediate panel foldably connected to the first intermediate panel along a first fold line, a third intermediate panel foldably connected to the second intermediate panel, and a fourth intermediate panel foldably connected to the second intermediate panel, the first intermediate panel is positioned in face-to-face contact with the second intermediate panel;

the reclosable lid is pivotable at the hinge between a closed position preventing access to the interior of the carton and an open position allowing access to the interior of the carton; and wherein the third intermediate panel includes a first corner portion defined by a tear line extending from an edge of the third intermediate panel and at least a portion of the first corner portion is in face-to-face contact with the first side panel.

24. The carton of claim 23 further comprises a plurality of end flaps, the plurality of end flaps are configured to close a first end of the carton, the end flaps comprises a first end flap foldably connected to the front panel, a second end flap foldably connected to the first side panel, a third end flap foldably connected to the second side panel, and a fourth end flap foldably connected to the back panel.

25. The carton of claim 24, wherein the first end flap is foldably connected to the front panel by the first intermediate panel and the second intermediate panel, the second end flap is foldably connected to the first side panel by the third intermediate panel, and the third end flap is foldably connected to the second side panel by the fourth intermediate panel.

26. The carton of claim 25, wherein the fourth end flap is foldably connected to the back panel at a fold line, and the reclosable lid comprises the end flaps and the hinge comprises the fold line.

27. A blank for forming a carton for holding and dispensing a product, the blank comprises:

a plurality of panels, the plurality of panels comprise a front panel, a back panel, a first side panel, and a second side panel;

a hinge in at least one of the plurality of panels;

lid features for forming a reclosable lid, the reclosable lid comprises a first intermediate panel removably connected to the front panel along a first tear line, a second intermediate panel foldably connected to the first intermediate panel along a first fold line, a third intermediate panel removably connected to the first side panel along a second tear line, and a fourth intermediate panel foldably connected to the third intermediate panel along a second fold line, the first intermediate panel is for being positioned in face-to-face contact with the second intermediate panel and the third intermediate panel is for being positioned in face-to-face contact with the fourth intermediate panel when the blank is formed into a carton; and wherein the fourth intermediate panel includes a first corner portion defined by a tear line extending from the second fold line and at least a portion of the first corner portion is for being positioned in face-to-face contact with the first side panel when the blank is formed into a carton.

28. The blank of claim 27, wherein the reclosable lid comprises a fifth intermediate panel removably connected to the second side panel along a third tear line and a sixth intermediate panel foldably connected to the fifth intermediate panel along a third fold line, the fifth intermediate panel is for being positioned in face-to-face contact with the sixth intermediate panel when the blank is formed into a carton.

29. The blank of claim 28, wherein the sixth intermediate panel includes a second corner portion defined by a tear line extending from the third fold line and at least a portion of the second corner portion is for being positioned in face-to-face contact with the second side panel when the blank is formed into a carton.

30. The blank of claim 28 further comprises a plurality of end flaps, the plurality of end flaps are configured to close a first end of the carton when the blank is formed into a carton, the end flaps comprises a first end flap foldably connected to the front panel, a second end flap foldably connected to the first side panel, a third end flap foldably connected to the second side panel, and a fourth end flap foldably connected to the back panel.

31. The blank of claim 30, wherein the first end flap is foldably connected to the front panel by the first intermediate panel and the second intermediate panel.

32. The blank of claim 31, wherein the second end flap is foldably connected to the first side panel by the third intermediate panel and the fourth intermediate panel.

33. The blank of claim 32, wherein the third end flap is foldably connected to the second side panel by the fifth intermediate panel and the sixth intermediate panel.

34. The blank of claim 33, wherein the fourth end flap is foldably connected to the back panel at a fold line.

35. The blank of claim 28, wherein a first cutout separates the third intermediate panel from the first intermediate panel and a second cutout separates the fifth intermediate panel from the first intermediate panel.

36. The blank of claim 27, wherein the lid features comprise a locking tab defined by at least one tear line in the first intermediate panel and the locking tab is foldably connected to the front panel.

37. The blank of claim 27, wherein the first fold line is substantially straight.

38. The blank of claim 27, wherein the first fold line is curved.

39. A blank for forming a carton for holding and dispensing a product, the blank comprises:

a plurality of panels, the plurality of panels comprise a front panel, a back panel, a first side panel, and a second side panel;

a hinge in at least one of the plurality of panels;

lid features for forming a reclosable lid, the reclosable lid comprises a first intermediate panel removably connected to the first side panel along a first tear line, a second intermediate panel foldably connected to the first intermediate panel along a first fold line, a third intermediate panel removably connected to the second side panel along a second tear line, and a fourth intermediate panel foldably connected to the second fold line, the first intermediate panel is for being positioned in face-to-face contact with the second intermediate panel and the third intermediate panel is for being positioned in face-to-face contact with the fourth intermediate panel when the blank is formed into a carton; and wherein the second intermediate panel includes a first corner portion defined by a tear line extending from the first fold line and at least a portion of the first corner portion is for being positioned in face-to-face contact with the first side panel when the blank is formed into a carton.

40. The blank of claim 39, wherein the reclosable lid comprises a fifth intermediate panel foldably connected to the second intermediate panel and the fourth intermediate panel.

41. The blank of claim 40, wherein a cutout separates the first intermediate panel from the third intermediate panel and the fifth intermediate panel from the front panel.

42. The blank of claim 41, wherein the blank comprises a locking tab defined by at least one tear line in the front panel, the locking tab is adjacent the cutout.

43. The blank of claim 42, wherein the locking tab is a first locking tab, the blank comprises a second locking tab foldably connected to the first side panel and defined by a tear line in the first intermediate panel and a third locking tab foldably connected to the second side panel and defined by a tear line in the third intermediate panel.

44. The blank of claim 40 further comprises a plurality of end flaps, the plurality of end flaps are configured to close a first end of the carton when the blank is formed into a carton, the end flaps comprises a first end flap foldably connected to the front panel, a second end flap foldably connected to the first side panel, a third end flap foldably connected to the second side panel, and a fourth end flap foldably connected to the back panel.

45. The blank of claim 44, wherein the second end flap is foldably connected to the first side panel by the first intermediate panel and the second intermediate panel, the third end flap is foldably connected to the second side panel by the third intermediate panel and the fourth intermediate panel.

46. The blank of claim 45, wherein the first end flap is foldably connected to the front panel by the fifth intermediate panel.

47. The blank of claim 46, wherein the fourth end flap is foldably connected to the back panel at a fold line, and the reclosable lid comprises the end flaps and the hinge comprises the fold line.

48. A blank for forming a carton for holding and dispensing a product, the blank comprises:

a plurality of panels, the plurality of panels comprise a front panel, a back panel, a first side panel, and a second side panel;

a hinge in at least one of the plurality of panels;

lid features for forming a reclosable lid, the reclosable lid comprises a first intermediate panel removably connected to the first front panel along a first tear line, a second intermediate panel foldably connected to the first intermediate panel along a first fold line, a third intermediate panel foldably connected to the second intermediate panel, and a fourth intermediate panel foldably connected to the second intermediate panel, the first intermediate panel is for being positioned in face-to-face contact with the second intermediate panel when the blank is formed into a carton; and wherein the third intermediate panel includes a first corner portion defined by a tear line extending from an edge of the third intermediate panel and at least a portion of the first corner portion is for being positioned in face-to-face contact with the first side panel when the blank is formed into a carton.

49. The blank of claim 48 further comprises a plurality of end flaps, the plurality of end flaps are configured to close a first end of the carton when the blank is formed into a carton, the end flaps comprises a first end flap foldably connected to the front panel, a second end flap foldably connected to the first side panel, a third end flap foldably connected to the second side panel, and a fourth end flap foldably connected to the back panel.

50. The blank of claim 49, wherein the first end flap is foldably connected to the front panel by the first intermediate panel and the second intermediate panel, the second end flap is foldably connected to the first side panel by the third intermediate panel, and the third end flap is foldably connected to the second side panel by the fourth intermediate panel.

51. A method of forming a carton for holding and dispensing a product, the method comprising:

obtaining a blank comprising a plurality of panels, the plurality of panels comprise a front panel, a back panel, a first side panel, and a second side panel; a hinge in at least one of the plurality of panels; lid features for forming a reclosable lid; the lid features comprise a first intermediate panel removably connected to the front panel along a first tear line, a second intermediate panel foldably connected to the first intermediate panel along a first fold line, a third intermediate panel removably connected to the first side panel along a second tear line, and a fourth intermediate panel foldably connected to the third intermediate panel along a second fold line, the fourth intermediate panel includes a first corner portion defined by a tear line extending from the second fold line;

forming an interior of the carton at least partially defined by the plurality of panels; and forming the reclosable lid by positioning the first intermediate panel in face-to-face contact with the second intermediate panel, positioning the third intermediate panel in face-to-face contact with the fourth intermediate panel, and positioning at least a portion of the first corner portion in face-to-face contact with the first side panel, the reclosable lid is pivotable at the hinge between a closed position preventing access to the interior of the carton and an open position allowing access to the interior of the carton.

52. The method of claim 51, wherein the method further comprises accessing the interior of the carton by separating the reclosable lid from the carton and pivoting the lid at the hinge to the open position.

53. The method of claim 51, wherein the method further comprises reclosing the carton by pivoting the reclosable lid at the hinge to the closed position.

54. The method of claim 53, wherein the reclosing the carton comprises engaging an at least one locking tab with a locking feature of the reclosable lid.

55. The method of claim 54, wherein the locking feature is a recess in the reclosable lid.

56. The method of claim 51, wherein the reclosable lid comprises a fifth intermediate panel removably connected to the second side panel along a third tear line and a sixth intermediate panel foldably connected to the fifth intermediate panel along a third fold line; and the method further comprises positioning the fifth intermediate panel in face-to-face contact with the sixth intermediate panel.

57. The method of claim 56, wherein the sixth intermediate panel includes a second corner portion defined by a tear line extending from the third fold line; and the method further comprises positioning at least a portion of the second corner portion in face-to-face contact with the second side panel.

58. The method of claim 51, wherein the lid features comprise a locking tab defined by at least one tear line in the first intermediate panel and the locking tab is foldably connected to the front panel.

59. A method of forming a carton for holding and dispensing a product, the method comprising:

obtaining a blank comprising a plurality of panels, the plurality of panels comprise a front panel, a back panel, a first side panel, and a second side panel; a hinge in at least one of the plurality of panels; lid features for forming a reclosable lid; the lid features comprise a first intermediate panel removably connected to the first side panel along a first tear line, a second intermediate panel foldably connected to the first intermediate panel along a first fold line, a third intermediate panel removably connected to the second side panel along a second tear line, and a fourth intermediate panel foldably connected to the third intermediate panel along a second fold line, the third intermediate panel includes a first corner portion defined by a tear line extending from the first fold line;

forming an interior of the carton at least partially defined by the plurality of panels; and forming the reclosable lid by positioning the first intermediate panel in face-to-face contact with the second intermediate panel, positioning the third intermediate panel in face-to-face contact with the fourth intermediate panel, and positioning at least a portion of the first corner portion in face-to-face contact with the first side panel, the reclosable lid is pivotable at the hinge between a closed position preventing access to the interior of the carton and an open position allowing access to the interior of the carton.

60. The method of claim 59, wherein the reclosable lid comprises a fifth intermediate panel foldably connected to the second intermediate side panel and the fourth intermediate side panel.

61. The method of claim 60, wherein a cutout separates the first intermediate panel from the third intermediate panel and the fifth intermediate panel from the front panel.

62. The method of claim 61, wherein the carton comprises a locking tab defined by at least one tear line in the front panel, the locking tab is adjacent the cutout.

63. The method of claim 62, wherein the locking tab is a first locking tab, the carton comprises a second locking tab foldably connected to the first side panel and defined by a tear line in the first intermediate panel and a third locking tab foldably connected to the second side panel and defined by a tear line in the third intermediate panel.

* * * * *